US010429054B2

(12) United States Patent
Kochanski

(10) Patent No.: US 10,429,054 B2
(45) Date of Patent: Oct. 1, 2019

(54) LIGHT BULB, A LIGHT BULB HOLDER, AND A COMBINATION OF A LIGHT BULB AND A LIGHT BULB HOLDER

(71) Applicant: Jerry Kochanski, Dublin (IE)

(72) Inventor: Jerry Kochanski, Dublin (IE)

( * ) Notice: Subject to any disclaimer, the term of this patent is extended or adjusted under 35 U.S.C. 154(b) by 497 days.

(21) Appl. No.: 14/438,424

(22) PCT Filed: Oct. 24, 2013

(86) PCT No.: PCT/IE2013/000021
§ 371 (c)(1),
(2) Date: Apr. 24, 2015

(87) PCT Pub. No.: WO2014/064671
PCT Pub. Date: May 1, 2014

(65) Prior Publication Data

US 2015/0285487 A1 Oct. 8, 2015

(30) Foreign Application Priority Data

Oct. 26, 2012 (IE) ..... S2012/0473
Aug. 14, 2013 (GB) ..... 1314528.9

(51) Int. Cl.
*F21V 29/74* (2015.01)
*F21V 29/00* (2015.01)
(Continued)

(52) U.S. Cl.
CPC ..... *F21V 29/74* (2015.01); *F21K 9/23* (2016.08); *F21K 9/232* (2016.08); *F21V 19/006* (2013.01);
(Continued)

(58) Field of Classification Search
CPC ..... F21V 29/74; F21V 29/60; F21V 29/677; F21V 29/00; F21V 19/006; F21V 23/009; F21K 9/23; F21K 9/232; H01R 33/22
(Continued)

(56) References Cited

U.S. PATENT DOCUMENTS 5,458,505 A 10/1995 Prager
2006/0050514 A1 3/2006 Opolka
(Continued)

FOREIGN PATENT DOCUMENTS

CN 101435568 A 5/2009
CN 101725945 A 6/2016
(Continued)

OTHER PUBLICATIONS

International Search Report of PCT/IE2013/000021 dated May 21, 2014.
(Continued)

*Primary Examiner* — Bao Q Truong
(74) *Attorney, Agent, or Firm* — Spruson & Ferguson (Hong Kong) Limited

(57) ABSTRACT

A combination (110) of a light bulb (111) and a bulb holder (112) in which the light bulb (111) comprises a plurality of light emitting diodes (77) mounted on a mounting platform (76) located within a globe (74) of the light bulb (111). The mounting platform (76) is mounted on and in heat conducting engagement with a heat transfer member (75) which is located within and in heat conducting engagement with an Edison screw threaded first coupling element (73) also of heat conductive material, so that heat generated by the light emitting diodes (77) is conducted through the mounting platform (76), the heat transfer member (75) and the first coupling element (73) into the light bulb holder (112). The light bulb holder (112) comprises a body member (93) of
(Continued)

Figure 1:
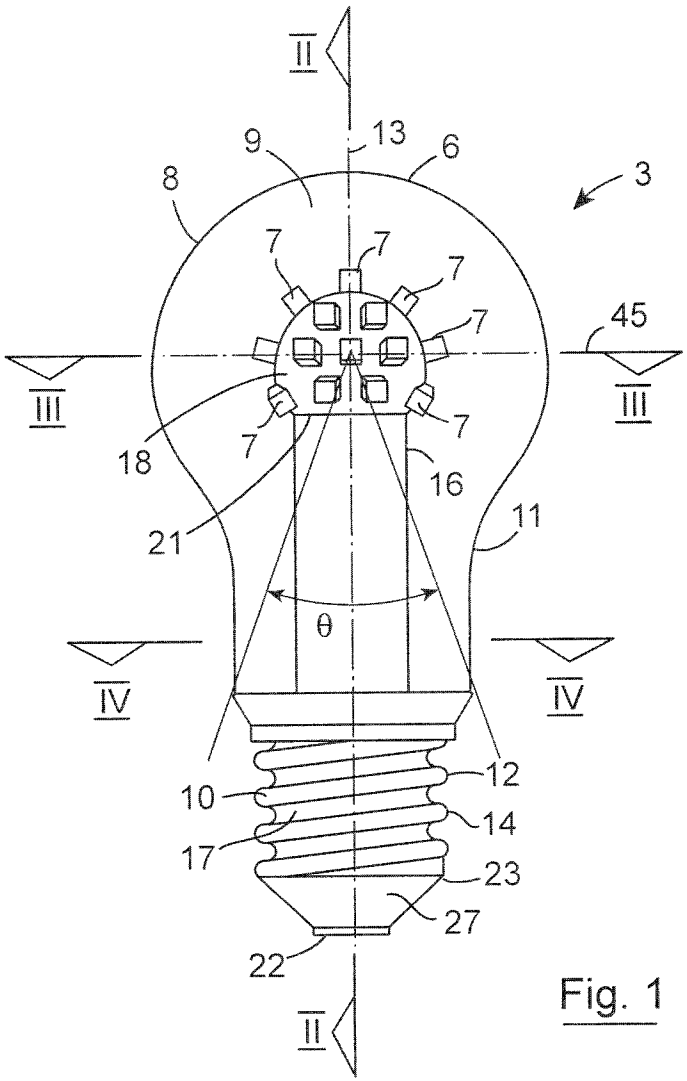

heat conductive material having an internally Edison screw threaded socket (95) engageable with the first coupling element (73) of the light bulb (111). A plurality of heat exchange fins (97) extending outwardly from the body member (93) sink heat conducted from the light bulb (111) into the light bulb holder (112). Concentric contact elements (115,116) located at the end of the first coupling elements (73) are engageable with corresponding concentric first and second contact elements (121,122) located in the socket (95) for providing an electrical power supply to the light emitting diodes (77).

18 Claims, 10 Drawing Sheets

(51) Int. Cl.

| | |
|---|---|
| ***F21V 19/00*** | (2006.01) |
| ***H01R 33/22*** | (2006.01) |
| ***F21V 29/67*** | (2015.01) |
| ***F21V 29/60*** | (2015.01) |
| ***F21V 23/00*** | (2015.01) |
| ***F21K 9/23*** | (2016.01) |
| ***F21K 9/232*** | (2016.01) |
| *F21V 3/02* | (2006.01) |
| *F21Y 115/10* | (2016.01) |
| *F21Y 107/20* | (2016.01) |

(52) U.S. Cl.
CPC ..... *F21V 23/009* (2013.01); *F21V 29/00* (2013.01); *F21V 29/60* (2015.01); *F21V 29/677* (2015.01); *H01R 33/22* (2013.01); *F21V 3/02* (2013.01); *F21Y 2107/20* (2016.08); *F21Y 2115/10* (2016.08)

(58) Field of Classification Search
USPC ..... 362/235
See application file for complete search history.

(56) References Cited

U.S. PATENT DOCUMENTS

| | | | |
|---|---|---|---|
| 2006/0232974 | A1 | 10/2006 | Lee et al. |
| 2010/0103621 | A1 | 4/2010 | Sun |

FOREIGN PATENT DOCUMENTS

| | | | |
|---|---|---|---|
| EP | 0806817 | A1 | 11/1997 |
| GB | 2483113 | A | 2/2012 |
| WO | 00/17569 | A1 | 3/2000 |
| WO | 2005078335 | A1 | 8/2005 |

OTHER PUBLICATIONS

Written Opinion of the International Searching Authority of PCT/IE2013/000021 dated May 21, 2014.
1st Office Action of CN 201380055684.9 issued from the State Intellectual Property Office of the People's Republic of China dated Aug. 1, 2017.
2nd Office Action of CN 201380055684.9 issued from the State Intellectual Property Office of the People's Republic of China dated Apr. 16, 2018.
3rd Office Action of CN 201380055684.9 issued from the State Intellectual Property Office of the People's Republic of China dated Jan. 14, 2019.
Office Action of EP13789049.7 issued from the European Patent Office dated Sep. 19, 2018.

LIGHT BULB, A LIGHT BULB HOLDER, AND A COMBINATION OF A LIGHT BULB AND A LIGHT BULB HOLDER

CROSS REFERENCE TO RELATED APPLICATIONS

This is a National Stage of International Application No. PCT/IE2013/000021 filed Oct. 24, 2013, claiming priority based on Irish Patent Application No. S2012/0473 filed Oct. 26, 2012 and British Patent Application No. 1314528.9 filed Aug. 14, 2013, the contents of all of which are incorporated herein by reference in their entirety.

The present invention relates to a light bulb, and in particular, to a light bulb of the type comprising one or more energy efficient light emitting devices, such as light emitting diodes, and the invention also relates to a light bulb holder and to a combination of a light bulb and a light bulb holder.

Light bulbs which comprise light emitting diodes are known. However, such light bulbs suffer from two problems. Firstly, light emitting diodes and other energy efficient light emitting devices tend to generate a significant amount of heat which if not rapidly conducted away from the light emitting devices results in overheating of the light emitting devices and subsequent deterioration and burn out of the light emitting devices.

In order to remove heat sufficiently rapidly from the light emitting devices in known light bulbs, it is necessary to provide a relatively large heat sink in the light bulb. The heat sink is located between a translucent globe of the light bulb and a coupling element of the light bulb for coupling the light bulb to a light bulb holder. In order that the heat sink can dissipate heat generated by the light emitting devices, the heat sink, in general, comprises a central longitudinally extending body member of heat conductive material and a plurality of heat exchange fins extending longitudinally along the body member, equi-spaced apart around the body member, and extending radially outwardly therefrom. The body member and the heat exchange fins typically are of aluminium or an aluminium alloy. In order that heat is dissipated from the heat exchange fins at the rate at which it is being generated by the light emitting devices, it is necessary that the transverse diameter of the heat sink across the heat exchange fins is relatively large, and is of such diameter that in general the translucent globe can be no more than a hemispherical globe located on the heat sink. In general, the transverse diameter of the heat sink across the heat exchange fins reduces towards the coupling element of the light bulb, so that the transverse diameter of the heat sink across the heat exchange fins at the coupling element is substantially similar to the diameter of the coupling element.

The requirement to locate such a heat sink between the translucent globe and the coupling element of a light bulb results in two problems. Firstly, each light bulb because it must contain the heat sink comprises a large amount of metal which increases the cost of the light bulb and also must be disposed of along with the light bulb, leading to significant wastage of metal, or at least a recycling requirement. Secondly, the requirement that the heat sink be located between the coupling element of the light bulb and the translucent globe of the light bulb, results in considerable restrictions in the directions from which light is emitted from the translucent globe.

While light from the light bulb is emitted outwardly from the translucent globe through an angle of 360° around a longitudinally extending central axis of the bulb, light is only emitted from the translucent globe through an angle of approximately 180° about an axis extending transversely of the longitudinal central axis of the light bulb, and contained in a plane defined by the junction of the hemispherical globe with the heat sink. This latter problem renders such bulbs unsatisfactory for use in standard lamps, table lamps, wall lamps and the like, since the light from the globes of such light bulbs is emitted upwardly and outwardly from the globe, with very little of the light being emitted downwardly from the light bulb below the plane defined by the junction of the hemispherical globe and the heat sink.

These are two serious problems of such light bulbs comprising light emitting devices, and in particular, comprising light emitting diodes.

There is therefore a need for a light bulb which addresses these problems, and there is also a need for a light bulb holder and a combination of a light bulb and a light bulb holder, which also address these problems.

The present invention is directed towards providing such a light bulb, a light bulb holder and a combination of a light bulb and a light bulb holder.

According to the invention there is provided a light bulb comprising a globe of translucent material defining a hollow interior region, a first coupling element extending from the globe for releasably coupling the light bulb to a light bulb holder, the first coupling element being configured for transferring heat to the light bulb holder, at least one electrically conductive contact element located adjacent the first coupling element configured to electrically contact a corresponding electrically conductive contact element in the light bulb holder, a mounting means located in the hollow interior region of the globe, at least one energy efficient light emitting device located in the hollow interior region of the globe on the mounting means and electrically coupled to the at least one contact element, and a heat transfer means coupled to the mounting means and to the first coupling element for transferring heat from the at least one light emitting device to the first coupling element for dissipation of the heat by the light bulb holder in which the first coupling element is engaged.

In one aspect of the invention the first coupling element defines a longitudinally extending central axis.

In another aspect of the invention the first coupling element is configured to engage the light bulb holder with heat conducting engagement.

In a further aspect of the invention the first coupling element comprises a plug element. Preferably, the first coupling element comprises a screw threaded portion adapted to engage a complimentary screw threaded portion of the light bulb holder. Advantageously, the screw threaded portion of the first coupling element comprises an externally threaded portion thereof. Ideally, the plug element is externally threaded.

In one aspect of the invention the screw threaded portion of the first coupling element comprises one of a fine screw thread, a coarse screw thread and an Edison screw thread.

Alternatively, the first coupling element comprises a bayonet cap plug element.

In another aspect of the invention the heat transfer means extends between the mounting means and the first coupling element. Preferably, the heat transfer means is located in the first coupling element. Advantageously, the heat transfer means is in heat conducting engagement with the first coupling element. Ideally, the heat transfer means is in heat conducting engagement with the mounting means.

Preferably, the heat transfer means is configured for transferring heat from the at least one light emitting device to the first coupling element by heat conduction. Advantageously, the heat transfer means comprises a heat conducting material. Advantageously, the heat transfer means comprises a heat transfer member in heat conducting engagement with the first coupling element.

In another aspect of the invention the at least one light emitting device is configured on the mounting means for transferring of heat from the at least one light emitting device to the mounting means. Preferably, the at least one light emitting device is configured on the mounting means for transferring of heat from the at least one light emitting device to the mounting means by heat conduction. Advantageously, the mounting means is mounted on the heat transfer means. Preferably, the mounting means is mounted on a distal end of the heat transfer means.

In another aspect of the invention the mounting means is located in the globe towards the first coupling element. Preferably, the mounting means is located in the globe adjacent the first coupling element.

In one aspect of the invention a lens is provided extending from the mounting means into the hollow interior region of the globe for conducting light from the at least one light emitting device to a location in the globe spaced apart from the first coupling element. Preferably, the lens extends from the mounting means to a location substantially centrally located in the hollow interior region of the globe.

In a further aspect of the invention the heat transfer means comprises an elongated pillar extending from the first coupling element into the hollow interior region of the globe, and the mounting means is mounted on the pillar. Preferably, the pillar terminates in a distal end adjacent a substantially central location of the hollow interior region of the globe. Advantageously, the mounting means is mounted on the pillar adjacent the distal end thereof.

In another aspect of the invention the heat transfer means comprises the first coupling element.

In another aspect of the invention the at least one contact element is located in the first coupling element concentric with the central axis. Preferably, a pair of the contact elements are located adjacent the first coupling element, the contact elements being spaced apart from each other and being configured to electrically contact respective corresponding contact elements in the light bulb holder. Advantageously, a first one of the pair of contact elements is concentric with the central axis and a second one of the pair of contact elements extends around the first contact element. Preferably, the second contact element is concentric with the first contact element. Advantageously, the first and second contact elements are electrically insulated from each other. Preferably, each contact element is electrically insulated from the first coupling element. Advantageously, each contact element is electrically insulated from the heat transfer means.

In another aspect of the invention the heat transfer means defines a bore extending therethrough for accommodating an electrical conductor from each contact element. Preferably, each electrical conductor extends from the corresponding contact element through the heat transfer means for providing an electrical power supply to the at least one light emitting device.

In a further aspect of the invention the heat transfer means, the mounting means and the first coupling element comprise an electrically conductive material and are electrically coupled to form an electrical ground for the at least one light emitting device.

In another aspect of the invention the mounting means defines an outer peripheral profile in plan view when viewed along the central axis, and the outer peripheral profile in plan view of the mounting means does not exceed an outer peripheral profile in plan view of the first coupling element when viewed along the central axis.

In a further aspect of the invention the mounting means comprises a platform on which the at least one light emitting device is located.

In another aspect of the invention the mounting means defines a partly substantially spherical surface on which the at least one light emitting device is located.

Preferably, the mounting means and the at least one light emitting device are located in the hollow interior region of the globe, so that light is emitted from the globe through an angle of 360° extending around the central axis.

Preferably, the mounting means and the at least one light emitting device are located in the hollow interior region of the globe so that light is emitted from the globe through an angle in the range of 270° to 355° about a secondary axis extending transversely relative to the main central axis adjacent the mounting means as the secondary axis is being rotated about the central axis. Preferably, the mounting means and the at least one light emitting device are located in the hollow interior region of the globe so that light is emitted from the globe through an angle in the range of 300° to 350° about the secondary axis. Advantageously, the mounting means and the at least one light emitting device are located in the hollow interior region of the globe so that light is emitted from the globe through an angle of approximately 340° about the secondary axis.

In one aspect of the invention a plurality of light emitting devices are mounted on the mounting means. Preferably, each light emitting device comprises a surface mounted light emitting device. Advantageously, each light emitting device comprises a light emitting diode.

In another aspect of the invention each light emitting device comprises a chip on board device.

Additionally, the invention provides a light bulb holder comprising a coupling element releasably engageable with a complementary coupling element of a light bulb for coupling the light bulb to the light bulb holder, the coupling element of the light bulb holder being configured to engage the coupling element of the light bulb for transferring heat from the light bulb to the light bulb holder through the coupling element of the light bulb holder, a heat sink in heat conducting engagement with the coupling element of the light bulb holder for sinking and dissipating heat transferred from the light bulb, and at least one electrically conductive contact element adjacent the coupling element of the light bulb holder, the at least one contact element being configured to electrically contact a corresponding electrically conductive contact element of the light bulb.

In one aspect of the invention the coupling element of the light bulb holder defines a longitudinally extending central axis.

In another aspect of the invention the heat sink comprises a heat exchanger, the heat exchanger comprising an elongated body member and a plurality of heat exchange fins extending outwardly from the body member. Preferably, the heat exchange fins extend in a generally longitudinal direction along the body member spaced apart circumferentially around the body member. Advantageously, the heat exchange fins extend substantially parallel to the central axis. Preferably, the heat exchange fins are equi-spaced apart circumferentially around the body member. Ideally, the heat exchange fins are of arcuate shape when viewed in plan along the central axis defined by the bulb holder. Preferably, the body member and the heat exchange fins comprise a heat conductive material.

In one aspect of the invention the body member comprises a large thermal mass.

In another aspect of the invention the coupling element of the light bulb holder comprises a socket element configured to engage the coupling element of a light bulb. Preferably, the coupling element of the bulb holder comprises a screw threaded portion. Advantageously, the socket defined by the coupling element of the bulb holder comprises an internally threaded socket. Preferably, the internally threaded socket of the coupling element comprises one of a fine screw thread, a coarse screw thread and an Edison screw thread.

Alternatively, the coupling element of the bulb holder comprises a bayonet socket.

In one aspect of the invention the coupling element of the bulb holder is formed in the body member, and is concentric with the body member.

In another aspect of the invention the at least one contact element is located in the coupling element of the bulb holder. Preferably, the at least one contact element is located concentrically with the central axis. Advantageously, the at least one contact element is located within the socket defined by the coupling element of the bulb holder.

In another aspect of the invention a pair of the electrically conductive contact elements are located adjacent the coupling element of the bulb holder, one of the pair of contact elements comprising a first contact element, and the other one of the pair of contact elements comprising a second contact element, the first and second contact elements of the bulb holder being configured for engaging corresponding ones of first and second contact elements of the bulb. Preferably, the first contact element of the bulb holder is located concentrically with the coupling element of the bulb holder. Advantageously, the second contact element of the bulb holder extends around the first contact element of the bulb holder. Preferably, the second contact element is located concentrically with the first contact element of the bulb holder.

In another aspect of the invention the first contact element is located concentrically with the central axis of the bulb holder.

In a further aspect of the invention a bore extends through the body member for accommodating an electrical conductor extending from each contact element located in the coupling element of the bulb holder.

Preferably, the body member comprises an electrically conductive material to form an electrical ground of the bulb holder.

In another aspect of the invention a driver for driving at least one light emitting device of a light bulb coupled to the bulb holder is located in the bulb holder.

In one embodiment of the invention an electronic control circuit for controlling a power supply to at least one light emitting device of a light bulb coupled to the bulb holder is located in the bulb holder.

In another embodiment of the invention a fan is located in the bulb holder to provide forced convection for dissipating heat from the heat sink.

The invention also provides a light bulb according to the invention and a light bulb holder according to the invention, in which the light bulb is engaged in the light bulb holder with the first coupling element of the light bulb engaged in the coupling element of the light bulb holder with heat conducting engagement for conducting heat from the light bulb to the light bulb holder for dissipation by the heat sink of the light bulb holder.

The invention also provides a combination of a light bulb and a light bulb holder, the light bulb comprising a globe of translucent material defining a hollow interior region, a first coupling element extending from the globe for releasably coupling the light bulb to the light bulb holder, the first coupling element being configured for transferring heat to the light bulb holder, at least one electrically conductive contact element located adjacent the first coupling element, a mounting means located in the hollow interior region of the globe, at least one energy efficient light emitting device located in the hollow interior region of the globe on the mounting means and electrically coupled to the at least one contact element, and a heat transfer means coupled to the mounting means and to the first coupling element for transferring heat from the at least one light emitting device to the first coupling element, the light bulb holder comprising a second coupling element in releasable heat transfer engagement with the first coupling element of the light bulb for coupling the light bulb to the light bulb holder and for transferring heat from the light bulb to the light bulb holder, a heat sink in heat conducting engagement with the second coupling element for sinking and dissipating heat transferred from the light bulb, and at least one electrically conductive contact element adjacent the second coupling element in electrically conductive contact with the contact element of the light bulb for providing an electrical power supply to the at least one light emitting device of the light bulb.

In one aspect of the invention the first coupling element defines a longitudinally extending central axis of the light bulb.

In another aspect of the invention the second coupling element defines a longitudinally extending central axis of the light bulb holder.

Preferably, the light bulb and the light bulb holder are configured so that when the light bulb is engaged in the light bulb holder, the central axes of the light bulb and the light bulb holder coincide.

Advantageously, the first and second coupling elements are configured to engage each other with heat conducting engagement.

In one aspect of the invention the first coupling element of the light bulb comprises a plug element.

In another aspect of the invention the second coupling element of the light bulb holder defines a socket for receiving the corresponding first coupling element of the light bulb.

In another aspect of the invention the first coupling element comprises a screw threaded portion, and the second coupling element comprises a complimentary screw threaded portion.

Preferably, the screw threaded portion of the first coupling element comprises an externally threaded portion thereof, and the screw threaded portion of the second coupling element comprises an internally threaded portion. Advantageously, the plug element of the light bulb is externally threaded.

Preferably, the socket defined by the second coupling element of the light bulb holder is internally threaded.

Advantageously, the screw threaded portions of the first and second coupling elements comprise one of a fine screw thread, a coarse screw thread and an Edison screw thread.

Alternatively, the first coupling element comprises a bayonet cap plug element, and the second coupling element comprises a bayonet socket element.

In one aspect of the invention the heat transfer means extends between the mounting means and the first coupling element.

In another aspect of the invention the heat transfer means is located in the first coupling element. Preferably, the heat transfer means is in heat conducting engagement with the first coupling element.

Advantageously, the heat transfer means is in heat conducting engagement with the mounting means. Ideally, the heat transfer means is configured for transferring heat from the at least one light emitting device to the first coupling element by heat conduction.

In one aspect of the invention the heat transfer means comprises a heat conducting material.

In another aspect of the invention the heat transfer means comprises a heat transfer member in heat conducting engagement with the first coupling element.

Preferably, the at least one light emitting device is configured on the mounting means for transferring of heat from the at least one light emitting device to the mounting means. Advantageously, the at least one light emitting device is configured on the mounting means for transferring of heat from the at least one light emitting device to the mounting means by heat conduction.

In another aspect of the invention the mounting means is mounted on the heat transfer means. Preferably, the mounting means is mounted on a distal end of the heat transfer means.

In another aspect of the invention the mounting means is located in the globe towards the first coupling element. Preferably, the mounting means is located in the globe adjacent the first coupling element.

In another aspect of the invention a lens is provided extending from the mounting means into the hollow interior region of the globe for conducting light from the at least one light emitting device to a location in the globe spaced apart from the first coupling element. Preferably, the lens extends from the mounting means along the central axis of the light bulb to a location substantially centrally located in the hollow interior region of the globe.

In another aspect of the invention the heat transfer means comprises an elongated pillar extending from the first coupling element into the hollow interior region of the globe, and the mounting means is mounted on the pillar. Preferably, the pillar terminates in a distal end adjacent a substantially central location of the hollow interior region of the globe on the central axis of the light bulb. Advantageously, the mounting means is mounted on the pillar adjacent the distal end thereof.

In another aspect of the invention the heat transfer means comprises the first coupling element.

In another aspect of the invention the at least one contact element of the light bulb is concentrically located with the first coupling element, and the at least one contact element of the light bulb holder is concentrically located with the second coupling element.

Preferably, the at least one contact element of the light bulb holder is located within the socket defined by the coupling element of the light bulb holder.

In another aspect of the invention a pair of the contact elements of the light bulb are located adjacent the first coupling element spaced apart from each other, and a pair of the contact elements of the light bulb holder are located adjacent the second coupling element spaced apart from each other and in electrical contact with corresponding ones of the contact elements of the light bulb. Preferably, a first one of the pair of contact elements of the light bulb comprises the centrally located contact element, and a second one of the pair of contact elements of the light bulb extends around the first contact element. Advantageously, the second contact element of the light bulb is concentric with the central axis of the light bulb. Preferably, the first contact element of the light bulb is concentric with the central axis of the light bulb. Advantageously, the first and second contact elements of the light bulb are electrically insulated from each other. Preferably, each contact element of the light bulb is electrically insulated from the first coupling element. Advantageously, each contact element of the light bulb is electrically insulated from the heat transfer means.

In one aspect of the invention the light bulb holder comprises a body member and the one of the internally threaded socket and the bayonet socket element extend into the body member.

In another aspect of the invention one of the contact elements of the pair of the contact elements of the light bulb holder comprising a first contact element, and the other one of the pair of contact elements of the light bulb holder comprising a second contact element, the first and second contact elements of the light bulb holder being in electrical contact with the first and second contact elements, respectively, of the light bulb.

Preferably, the first contact element of the light bulb holder is located centrally relative to the second coupling element of the light bulb holder. Advantageously, the second contact element of the light bulb holder extends around the first contact element of the bulb holder. Preferably, the second contact element of the light bulb holder is located concentrically with the first contact element of the light bulb holder. Advantageously, the first contact element of the light bulb holder is located concentrically with the central axis of the light bulb holder.

In one aspect of the invention the first and second contact elements of the light bulb holder are electrically insulated from each other. Advantageously, each contact element of the light bulb holder is electrically insulated from the second coupling element. Preferably, each contact element of the light bulb holder is electrically insulated from the body member of the light bulb holder.

In another aspect of the invention the heat transfer means defines a bore extending therethrough for accommodating an electrical conductor from each contact element of the light bulb. Preferably, each electrical conductor extends from the corresponding contact element of the light bulb through the bore extending through the heat transfer means for supplying electrical power to the at least one light emitting device.

In another aspect of the invention a bore extends through the body member of the light bulb holder for accommodating an electrical conductor extending from each contact element of the light bulb holder for applying an electrical power supply to the corresponding contact element.

Preferably, the at least one contact element of the light bulb holder is located in the second coupling element of the light bulb holder.

Advantageously, the heat transfer means, the mounting means and the first coupling element of the light bulb comprise an electrically conductive material and are configured to form an electrical ground for the at least one light emitting device.

In another aspect of the invention the body member comprises an electrically conductive material to form an electrical ground of the bulb holder.

In a further aspect of the invention the mounting means defines an outer peripheral profile in plan view when viewed along the central axis of the light bulb, and the outer peripheral profile in plan view of the mounting means does not exceed an outer peripheral profile in plan view of the first coupling element when viewed along the central axis of the light bulb.

In a further aspect of the invention the mounting means comprises a platform on which the at least one light emitting device is located.

In one aspect of the invention the mounting means defines a partly substantially spherical surface on which the at least one light emitting device is located.

In another aspect of the invention the mounting means and the at least one light emitting device are located in the hollow interior region of the globe, so that light is emitted from the globe through an angle of 360° extending around the central axis of the light bulb.

Preferably, the mounting means and the at least one light emitting device are located in the hollow interior region of the globe so that light is emitted from the globe through an angle in the range of 270° to 355° about a secondary axis extending transversely relative to the central axis adjacent the mounting means as the secondary axis is being rotated about the central axis. Preferably, the mounting means and the at least one light emitting device are located in the hollow interior region of the globe so that light is emitted from the globe through an angle in the range of 300° to 350° about the secondary axis. Advantageously, the mounting means and the at least one light emitting device are located in the hollow interior region of the globe so that light is emitted from the globe through an angle of approximately 340° about the secondary axis.

Preferably, a plurality of light emitting devices are mounted on the mounting means.

In one aspect of the invention each light emitting device comprises a surface mounted light emitting device.

In another aspect of the invention each light emitting device comprises a light emitting diode.

In another aspect of the invention each light emitting device comprises a chip on board device.

In another aspect of the invention the heat sink of the light bulb holder comprises a heat exchanger, the heat exchanger comprising the body member and a plurality of heat exchange fins extending outwardly from the body member. Preferably, the body member of the light bulb holder comprises an elongated body member. Advantageously, the heat exchange fins extend in a generally longitudinal direction along the body member spaced apart circumferentially around the body member. Preferably, the heat exchange fins extend substantially parallel to the central axis of the light bulb holder. Advantageously, the heat exchange fins are equi-spaced apart circumferentially around the body member. Preferably, the heat exchange fins are of arcuate shape when viewed in plan along the central axis of the light bulb holder.

In one aspect of the invention the body member and the heat exchange fins comprise a heat conductive material.

In another aspect of the invention the body member comprises a large thermal mass.

Preferably, the second coupling element of the bulb holder is formed in the body member, and is concentric with the body member.

In another aspect of the invention a driver for driving at least one light emitting device of a light bulb is located in the bulb holder.

In a further aspect of the invention an electronic control circuit is provided for controlling the electrical power supply to the at least one light emitting device.

In a still further aspect of the invention a fan is located in the bulb holder to provide forced convection for dissipating heat from the heat sink.

Figure 2:
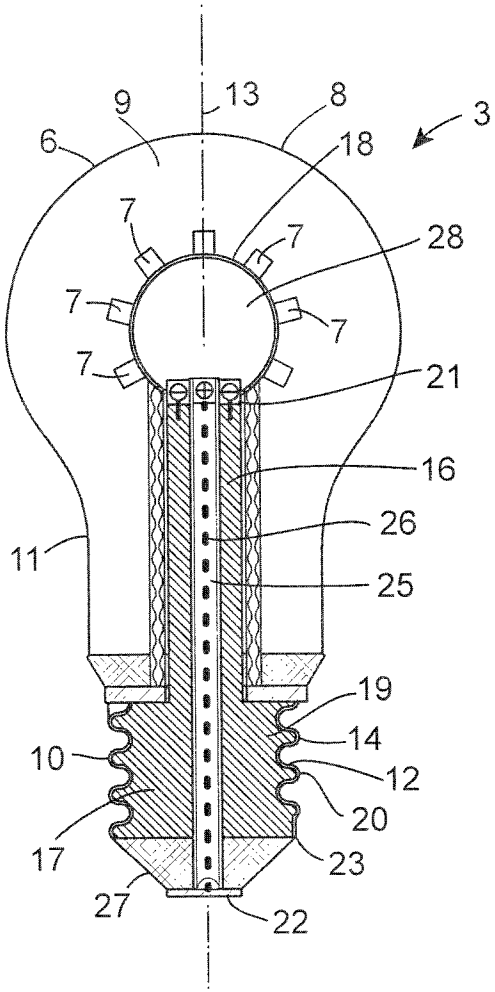
Figure 3:
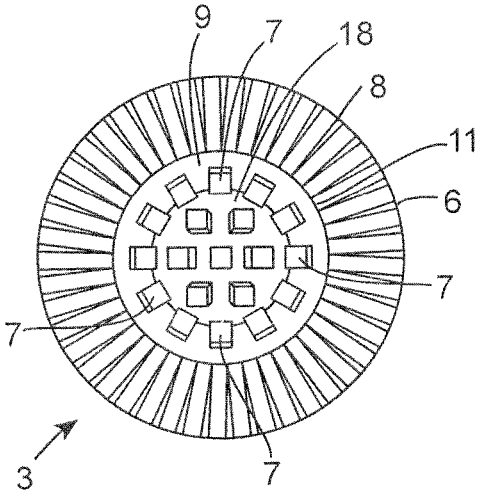
Figure 4:
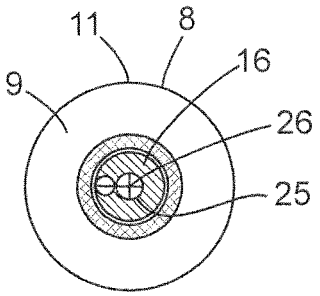
Figure 5:
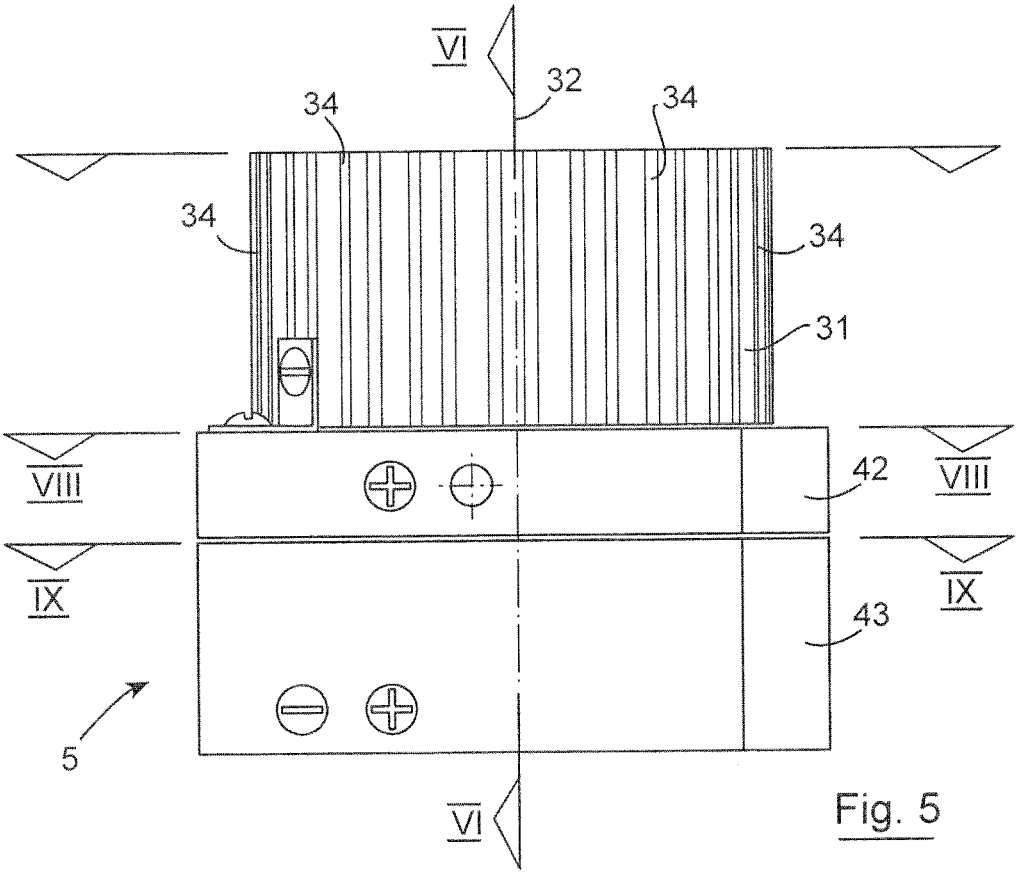
Figure 7:
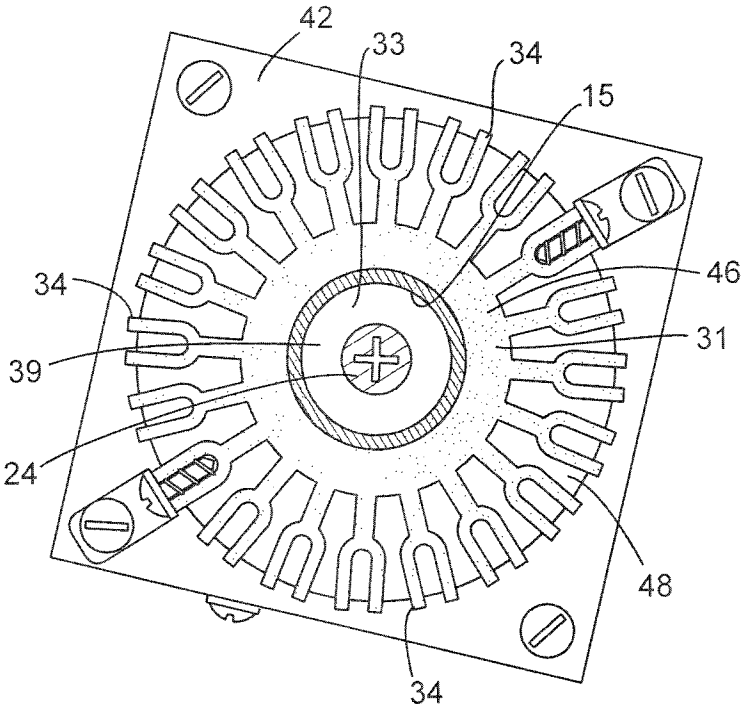
Figure 6:
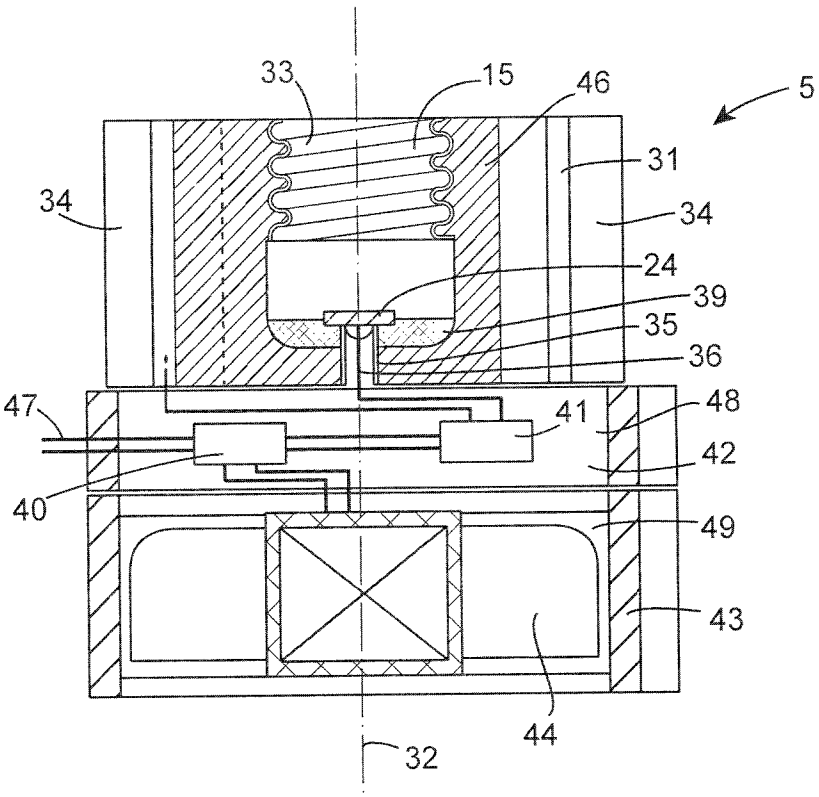
Figure 9:
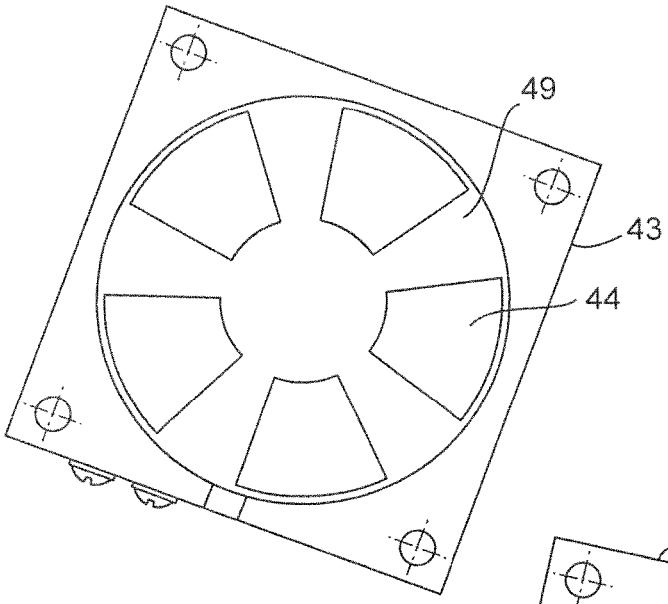
Figure 8:
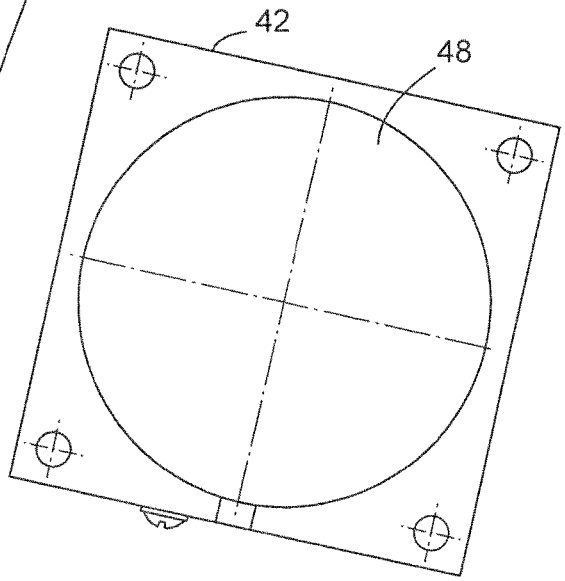
Figure 21:
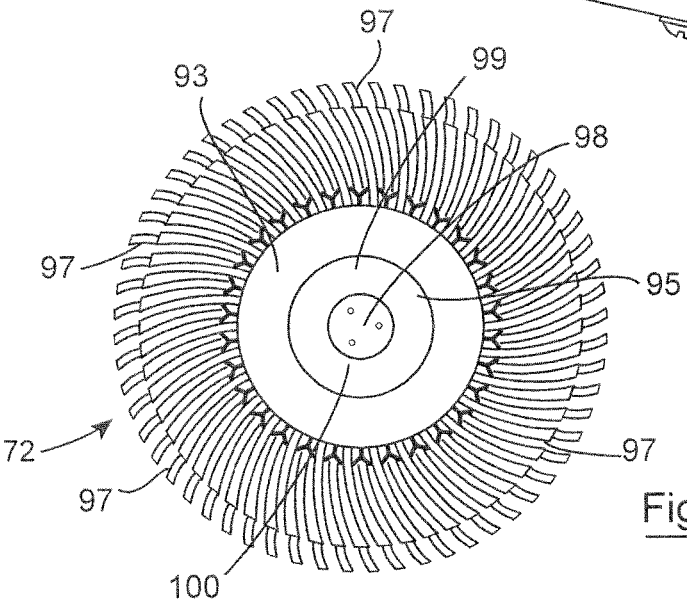
Figure 12:
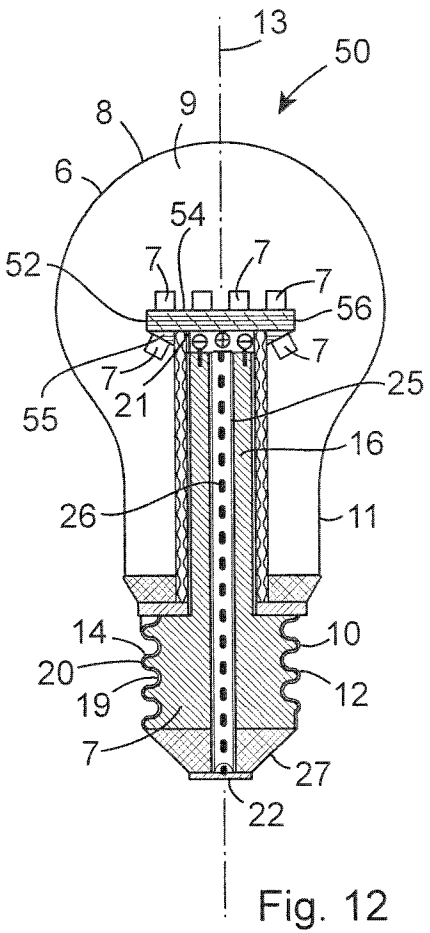
Figure 11:
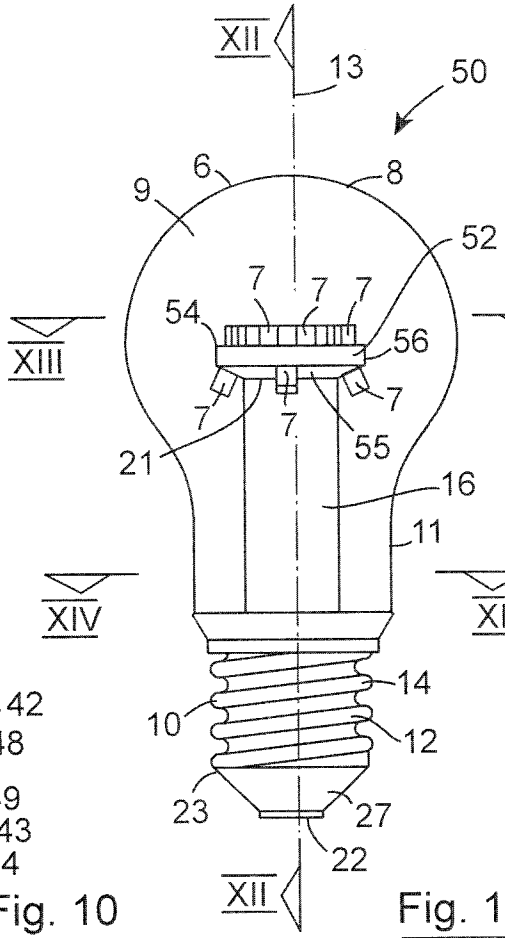
Figure 10:
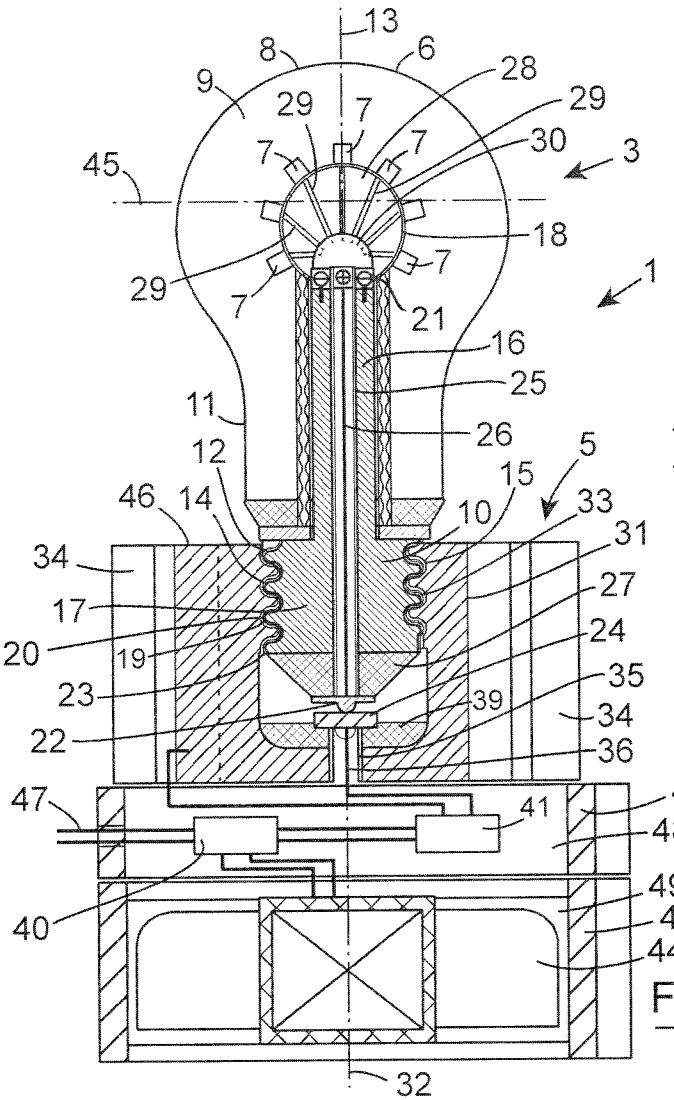
Figure 15:
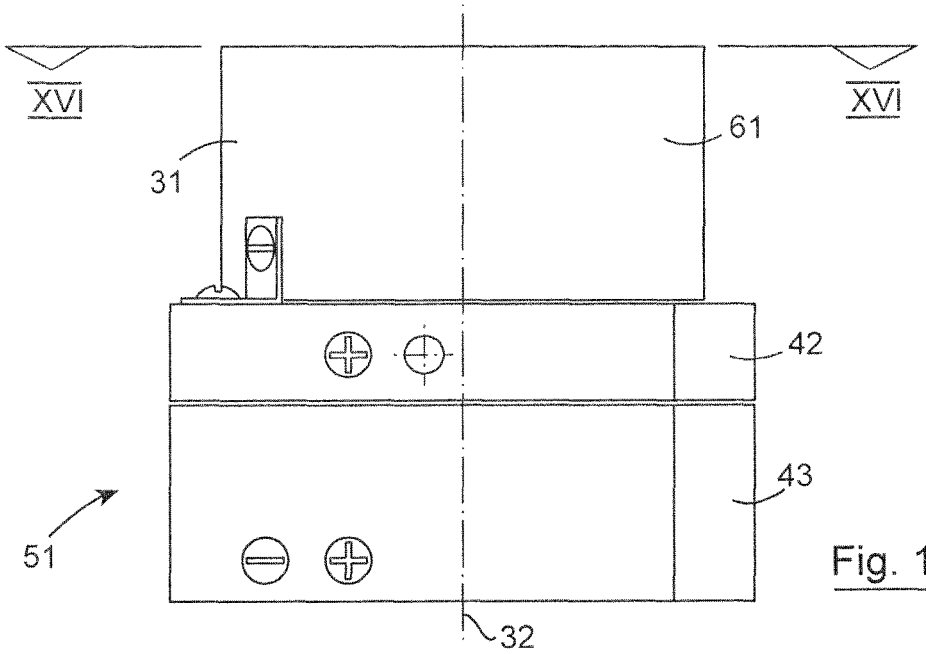
Figure 16:
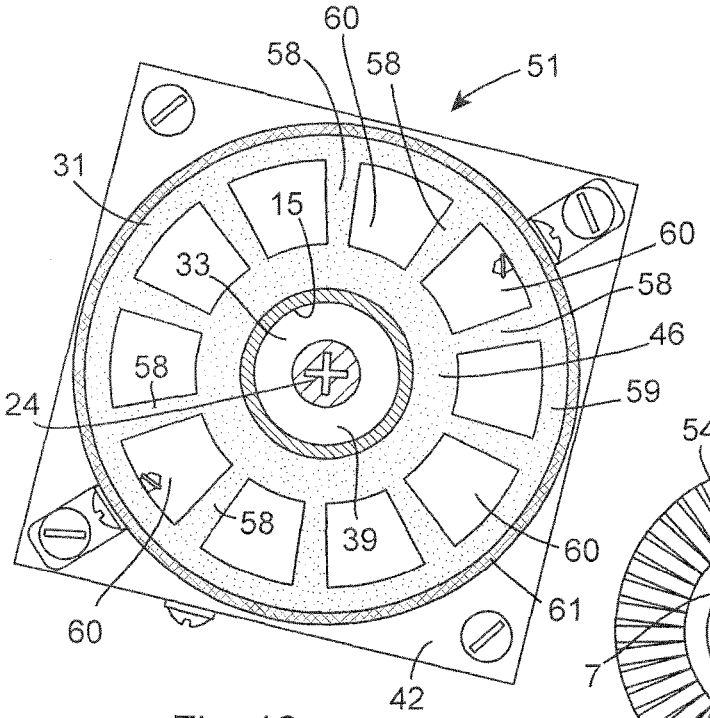
Figure 14:
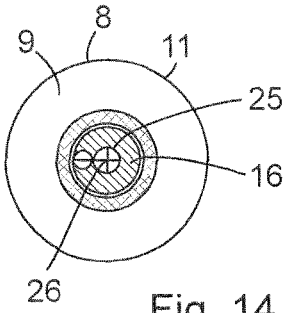
Figure 13:
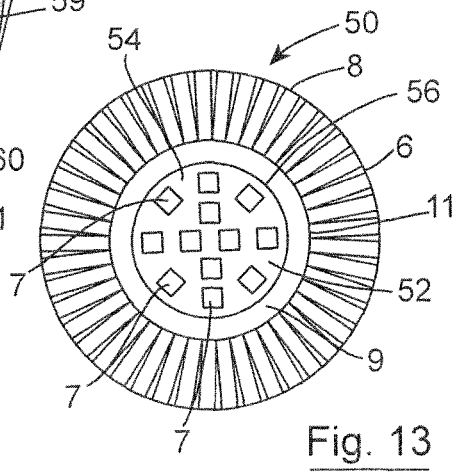
Figure 17:
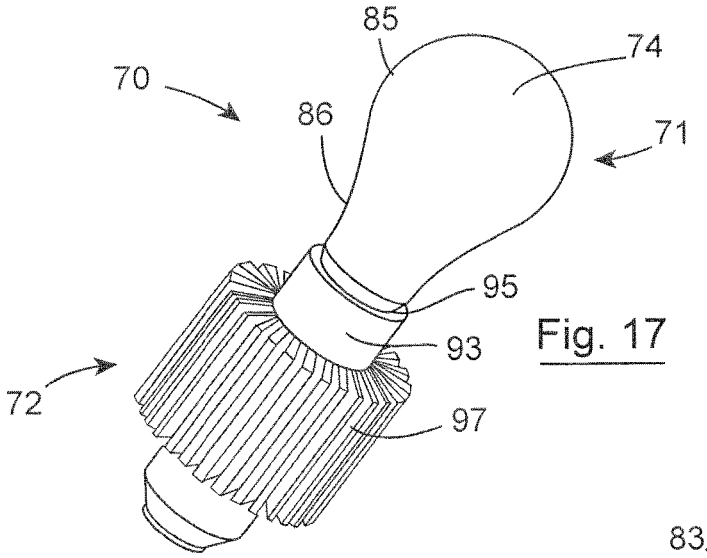
Figure 19:
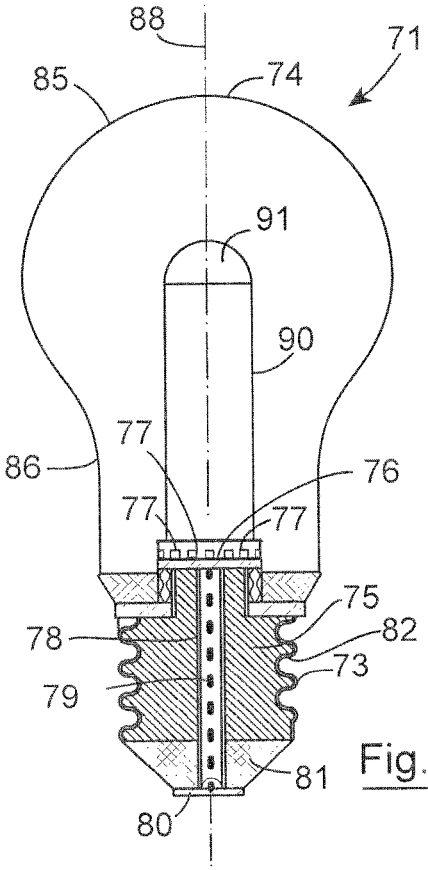
Figure 20:
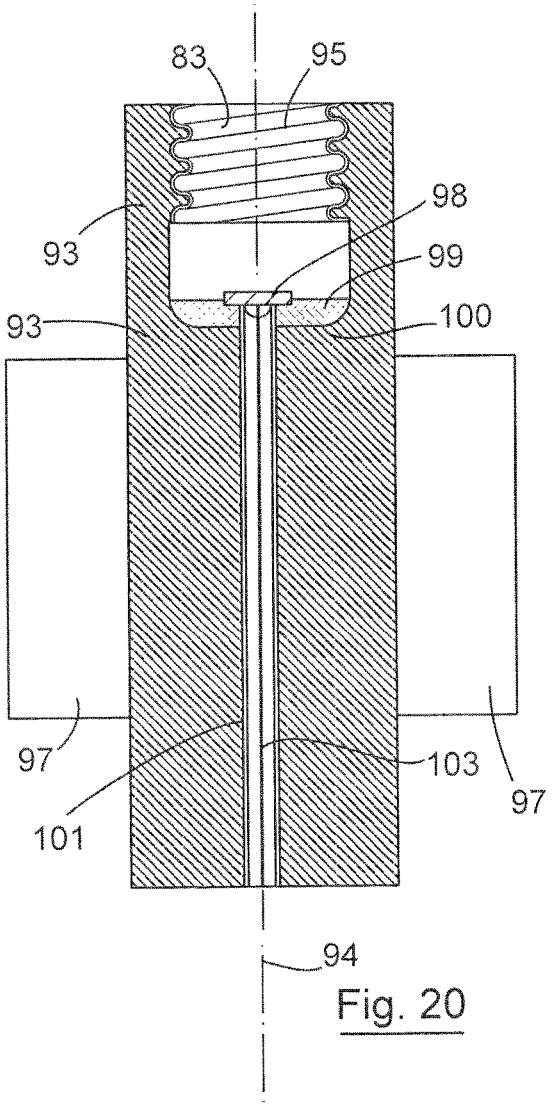
Figure 18:
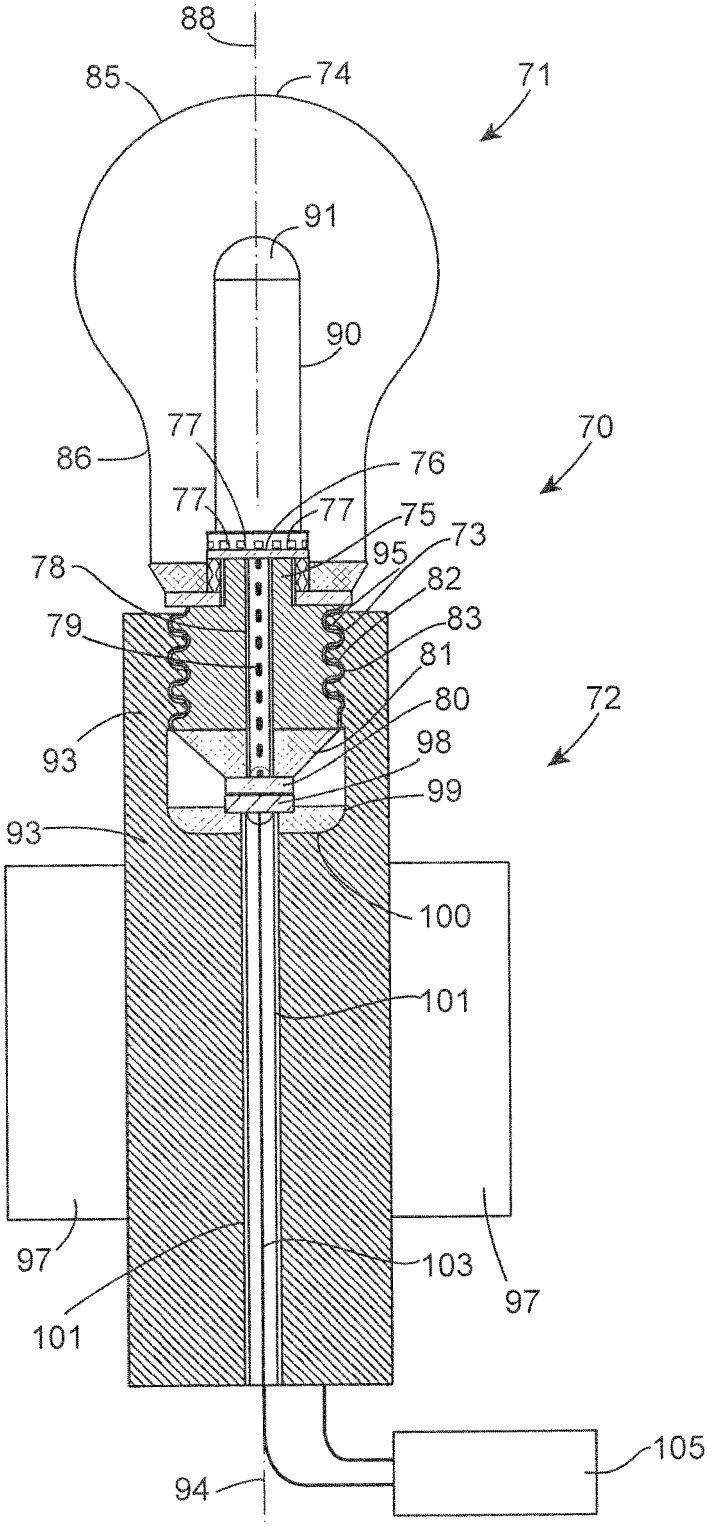
Figure 22:
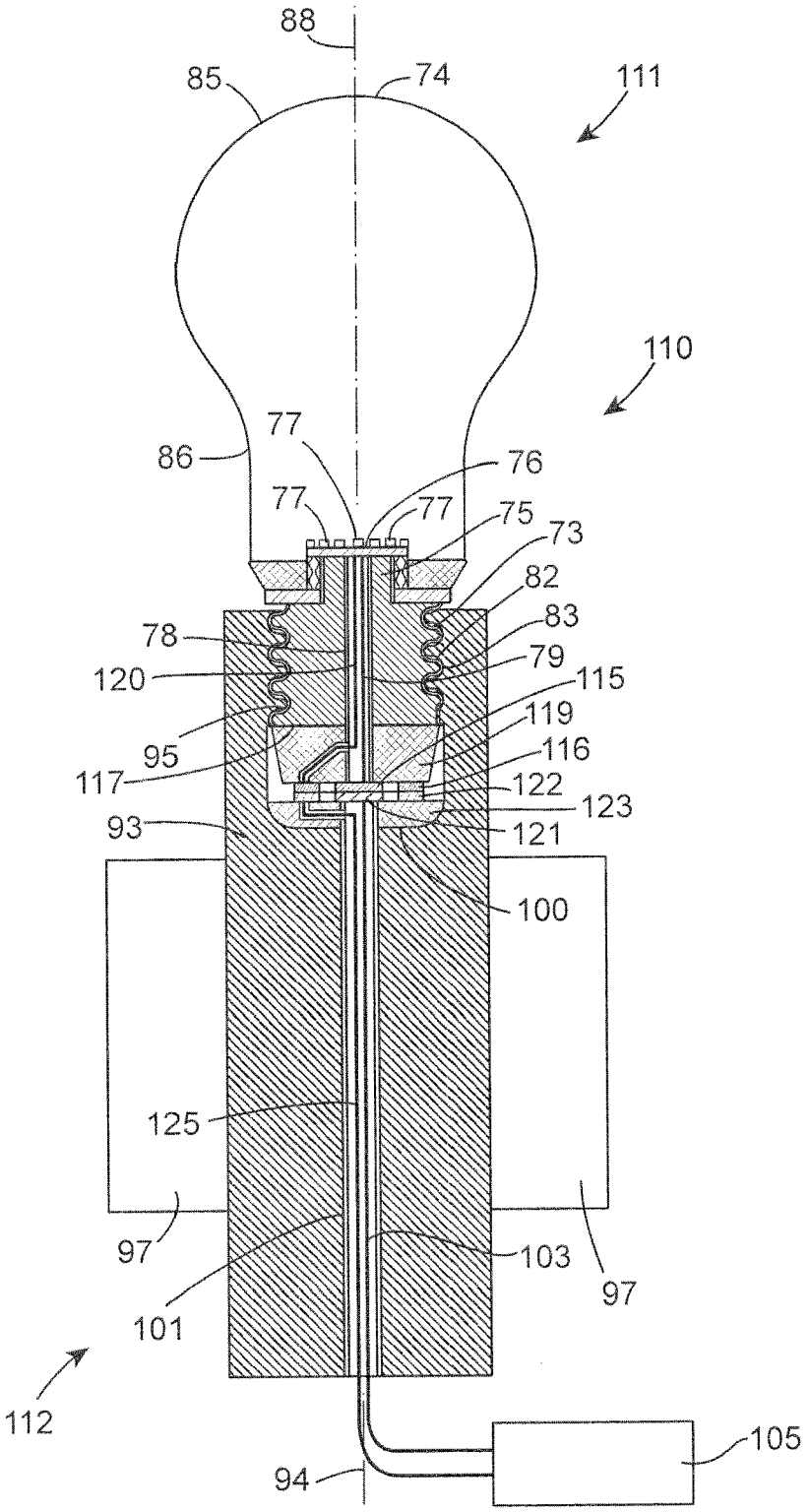
Figure 24:
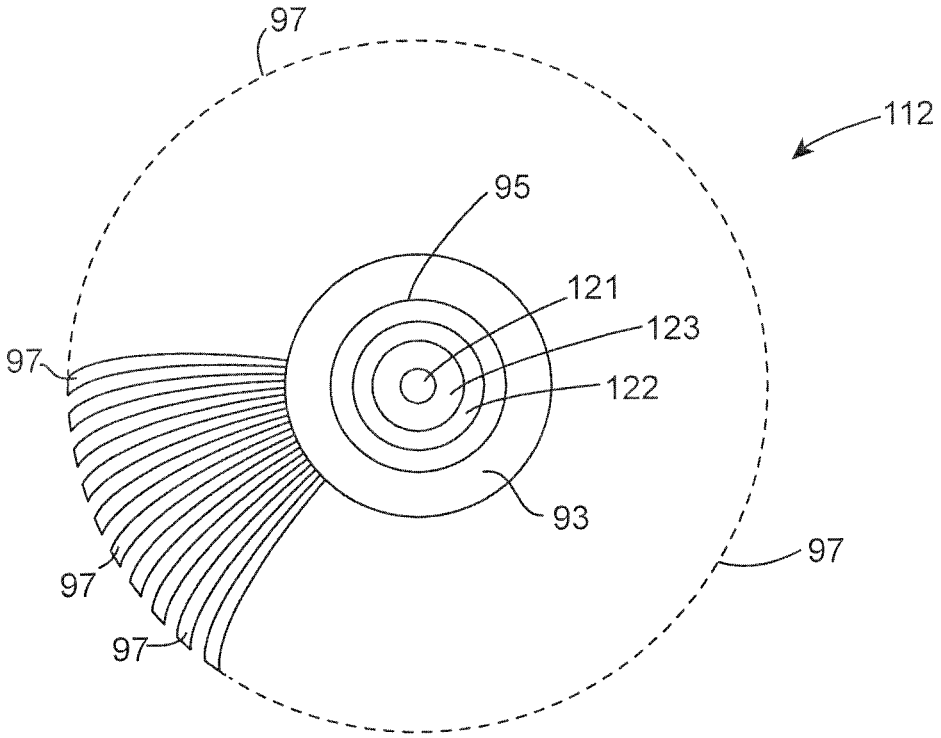
Figure 23:
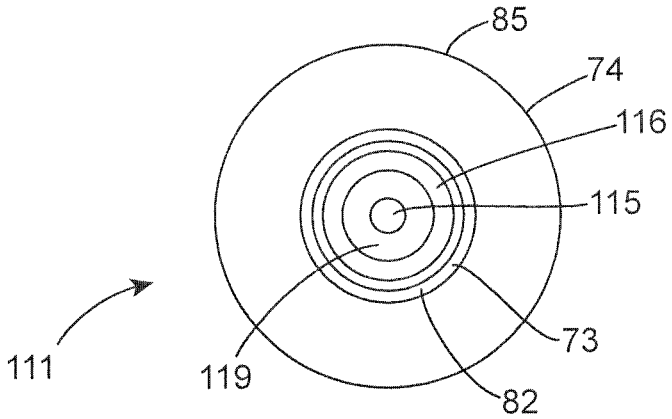

The invention will be more clearly understood from the following description of some preferred embodiments thereof, which are given by way of example only, with reference to the accompanying drawings, in which:

FIG. 1 is a front elevational view of a light bulb according to the invention, FIG. 2 is a cross-sectional side elevational view of the light bulb of FIG. 1 on the line II-II of FIG. 1, FIG. 3 is a cross-sectional top plan view of the light bulb of FIG. 1 on the line III-III of FIG. 1, FIG. 4 is a cross-sectional top plan view of the light bulb of FIG. 1 on the line IV-IV of FIG. 1, FIG. 5 is a front elevational view of a light bulb holder also according to the invention for use in combination also according to the invention with the light bulb of FIG. 1, FIG. 6 is a cross-sectional side elevational view of the light bulb holder of FIG. 5 on the line VI-VI of FIG. 5, FIG. 7 is a top plan view of the light bulb holder of FIG. 5, FIG. 8 is a cross-sectional top plan view of the light bulb holder of FIG. 5 on the line VIII-VIII of FIG. 5, FIG. 9 is a cross-sectional top plan view of the light bulb holder of FIG. 5 on the line IX-IX of FIG. 5, FIG. 10 is a cross-sectional front elevational view of the combination according to the invention of the light bulb of FIG. 1 and of the light bulb holder of FIG. 5, FIG. 11 is a front elevational view of a light bulb according to another embodiment of the invention, FIG. 12 is a cross-sectional side elevational view of the light bulb of FIG. 11 on the line XII-XII of FIG. 11, FIG. 13 is a cross-sectional top plan view of the light bulb of FIG. 11 on the line XIII-XIII of FIG. 11, FIG. 14 is a cross-sectional top plan view of the light bulb of FIG. 11 on the line XIV-XIV of FIG. 11, FIG. 15 is a front elevational view of a light bulb holder according to another embodiment of the invention, FIG. 16 is a cross-sectional top plan view of the light bulb holder of FIG. 15 on the line XVI-XVI of FIG. 15, FIG. 17 is a perspective view of a combination according to the invention of a light bulb also according to the invention and a light bulb holder also according to the invention, FIG. 18 is a cross-sectional side elevational view of the combination of the light bulb and the light bulb holder of FIG. 17, FIG. 19 is a cross-sectional side elevational view of the light bulb of the combination of FIG. 17, FIG. 20 is a cross-sectional side elevational view of the light bulb holder of the combination of FIG. 17, FIG. 21 is a top plan view of the light bulb holder of the combination of FIG. 17, FIG. 22 is a cross-sectional side elevational view of a combination according to another embodiment of the invention of a light bulb also according to the invention, and a light bulb holder also according to the invention, FIG. 23 is an underneath plan view of the light bulb of the combination of FIG. 22, and FIG. 24 is a top plan view of the light bulb holder of the combination of FIG. 22.

Referring to the drawings and initially to FIGS. 1 to 10 thereof, there is illustrated a combination according to the invention, indicated generally by the reference numeral 1, see FIG. 10, of a light bulb also according to the invention and indicated generally by the reference numeral 3 and a light bulb holder also according to the invention and indicated generally by the reference numeral 5. The light bulb 3 comprises a plurality of light emitting devices 7, which in this embodiment of the invention are surface mounted light emitting diodes. A globe 8 of translucent glass defines a hollow interior region 9 within which the light emitting devices 7 are located as will be described below. A first coupling element 10 for releasably coupling the light bulb 3 to the light bulb holder 5 extends from the globe 8, and is secured to the globe 8 by a suitable bonding cement or other such suitable securing means. The globe 8 comprises a partly spherical part 6, which terminates in a cylindrical part 11, which in turn extends to the first coupling element 10. The first coupling element 10 along with the globe 8 defines a longitudinally extending central axis 13 of the light bulb 3.

In this embodiment of the invention the first coupling element 10 comprises an outer shell 12 in the form of a plug element which is provided with an external screw thread 14 which is adapted to releasably engage a corresponding internal screw thread 15 in the light bulb holder 5 as will be described below. The external and internal screw threads 14 and 15, respectively, may be fine screw threads or coarse screw threads or Edison screw threads. The outer shell 12 of the coupling element 10 is of a heat and electrically conductive material, which in this embodiment of the invention may be brass, copper or aluminium for conducting heat from the light bulb 3 to the light bulb holder 5 for dissipation thereof as will also be described below.

A heat transfer means comprising a heat transfer member, which in this embodiment of the invention is provided by an elongated pillar 16 of heat and electrically conductive material, which in this case may be copper, brass or aluminium is secured to and is in heat and electrical conducting engagement with the outer shell 12 of the coupling element 10, and is concentric with the central axis 13, and extends from the outer shell 12 of the coupling element 10 into the hollow interior region 9 of the globe 8. The pillar 16 terminates at a proximal end 17 in an externally threaded plug portion 19 which engages corresponding internal threads 20 of the outer shell 12 of the first coupling element 10. The threads on the plug portion 19 of the pillar 16 and the internal threads 20 of the outer shell 12 typically will be of similar type to those of the external screw threads 14 of the outer shell 12, but may be of another type.

A mounting means comprising a spherical mounting member 18 of heat and electrically conductive material, which in this embodiment of the invention may be of copper, brass or aluminium is mounted on a distal end 21 of the pillar 16 within the hollow interior region 9 of the globe 8 for carrying the light emitting devices 7. The mounting member 18 is hollow but of sufficient wall thickness to provide good heat conduction from the light emitting devices 7 mounted thereon, and is in heat conducting engagement with the pillar 16 for transferring heat by conduction from the light emitting diodes to the pillar 16. The mounting member 18 is substantially centrally located in the partly spherical part 6 of the globe 8 and is concentric with the partly spherical part 6 of the globe 8.

An electrically conductive contact element 22 is located adjacent an end 23 of the outer shell 12 of the coupling element 10 for electrically engaging a corresponding contact element 24 in the light bulb holder 5, as will be described below for providing an electrical supply to the light bulb 3. The contact element 22 is concentric with the central axis 13 of the light bulb 3, and is electrically insulated from the outer shell 12 of the coupling element 10 by a member 27 of an electrical insulating material in a similar manner as such a contact element is electrically insulated from a corresponding outer shell of a coupling element of a conventional incandescent bulb. The contact element 22 is also electrically insulated from the plug portion 19 of the pillar 16.

A longitudinally extending central bore 25 extends through the pillar 16 and accommodates an electrical conductor 26 from the contact element 22 to a connector element 30 located in a hollow interior region 28 defined by the mounting member 18. The conductor 26 is electrically connected to the contact element 22 and to the connector element 30, and is electrically insulated from the outer shell 12, the pillar 16 and the mounting member 18. The positive terminals (not shown) of the respective light emitting devices 7 are electrically coupled to the connector element 30 by wires 29 which extend through the mounting member 18 to the positive terminals (not shown) of the light emitting devices 7. The connector element 30 is electrically insulated from the pillar 16 and the mounting member 18, and the wires 29 are electrically insulated from the mounting member 18. The negative terminals of the respective light emitting devices 7 are connected to the mounting member 18, which is electrically coupled to the outer shell 12 of the first coupling element 10 through the pillar 16 in order to provide a ground connection for the negative terminals of the light emitting devices 7 from the light bulb holder 5, as will be described below.

The light emitting devices 7 are mounted on the mounting member 18 so that a substantially large proportion of the heat generated by the light emitting devices 7 is transferred from the light emitting devices 7 to the mounting member 18 by heat conduction. As mentioned above, the wall thickness of the spherical mounting member 18 is such as to readily conduct heat generated by the light emitting devices 7 from the light emitting devices 7 into the pillar 16. Similarly, the wall thickness of the pillar 16 is sufficient to conduct heat generated by the light emitting devices 7 from the mounting member 18 to the outer shell 12 of the coupling element 10, which in turn, as will be described below, is conducted into the light bulb holder 5, which acts as a heat sink from which the heat generated by the light emitting devices 7 is dissipated in order that the light emitting devices 7 operate at a temperature below the critical safe operating temperature of 70° C.

Turning now to the light bulb holder 5, the light bulb holder 5 comprises a cylindrical housing 31 comprising an elongated cylindrical body member 46 both of heat and electrically conductive material, for example, brass, copper or aluminium. The housing 31 defines a longitudinally extending central axis 32 which coincides with the longitudinally extending central axis 13 of the light bulb 3, when the light bulb 3 is coupled to the light bulb holder 5. The housing 31 comprises a second coupling element formed by a socket 33 extending into the body member 46, and which is internally threaded with the internal screw thread 15 for engaging the external screw thread 14 of the outer shell 12 of the first coupling element 10 of the light bulb 3 with electrical and heat conducting engagement, so that heat conducted into the outer shell 12 of the coupling element 10 through the pillar 16 from the spherical mounting member 18 from the light emitting devices 7 is readily conducted into the body member 46 of the housing 31 of the light bulb holder 5. The socket 33 is centrally located in the body member 46 and in turn in the housing 31, and extends concentrically with the central axis 32 of the light bulb holder 5.

A heat sink for dissipating heat from the housing 31 comprises a heat exchange means provided by a plurality of heat exchange fins 34 which extend radially from and are equi-spaced apart circumferentially around the body member 46 and extend longitudinally along the body member 46 and parallel to each other and parallel to the central axis 32 of the light bulb holder 5. The heat exchange fins 34 are of a heat and an electrically conductive material, for example, brass, copper or aluminium, similar to the material of the body member 46, and are integrally formed with the body member 46. The body member 46 and the heat exchange fins 34 may be formed from an extrusion, may be machined, or alternatively, the body member 46 and the heat exchange fins 34 may be cast or fabricated.

The contact element 24 is of electrical conductive material and is concentrically located in the socket 33, and is concentric with the central axis 32 of the light bulb holder 5. The contact element 24 is electrically insulated from the body member 46 by an electrically insulating material 39. A bore 35 extending longitudinally and centrally through the body member 46 of the housing 31 from the socket 33 accommodates an electrical conductor 36 from the contact element 24 in the socket 33 of the body member 46. The conductor 36 is electrically insulated from the body member 46.

An electronic control circuit 40 and a driver 41 for supplying electrical power at a stepped down voltage to the light emitting devices 7 in the light bulb 3, and for controlling the operation of and driving of the light emitting devices 7 is located in an open ended cylindrical chamber 48 extending through a first sub-housing 42, which is secured to and located upstream of the housing 31. Wires 47 extending from the control circuit 40 are adapted to receive an AC mains electricity supply. The positive output from the driver circuit 41 is applied to the conductor 36, and the negative output from the driver circuit 41 is applied to the housing 31. The positive supply from the driver circuit 41 is applied to the positive terminals of the light emitting devices 7 through the conductor 36, the contact elements 22 and 24, the conductor 26, the connector element 30 and the wires 29. The negative supply from the driver circuit 41 is applied to the negative terminals of the light emitting devices 7 through the housing 31 of the light bulb holder 5, the outer shell 12 of the first coupling element 10 of the light bulb 3, the pillar 16 and the mounting member 18, since the housing 31, the outer shell 12, the pillar 16 and the mounting member 18 are all of electrically conductive material, and all are in electrical contact engagement.

Alternatively, the sub-housing 42 comprising the electronic control circuit and the driver may be located separately and remotely from the light bulb holder 5.

A second sub-housing 43 secured to the first sub-housing 42 houses a fan 44 in an open ended cylindrical chamber 49 for delivering a stream of air through the chamber 48 in the first sub-housing 42, and in turn along and through the heat exchange fins 34 of the housing 31 of the light bulb holder 5 to produce forced convection through the heat exchange fins 34 for dissipating heat from the light bulb holder 5 conducted from the light emitting devices 7 into the light bulb holder 5. The fan 44 is powered and controlled by the control circuit 40.

The housing 31 forms a relatively large thermal mass in order to sink and dissipate heat generated by the light emitting devices 7 so that the temperature of the light emitting devices 7 does not exceed the critical safe operating temperature of 70° C. at which the light emitting devices 7 would deteriorate or fail. Indeed, in this embodiment of the invention the heat conducting capacity of the mounting member 18, the pillar 16, the outer shell 12 of the first coupling element 10 together with the heat sinking and dissipating capacity of the housing 31, the body member 46 and the heat exchange fins 34 of the light bulb holder 5 is sufficient to maintain the temperature of the light emitting devices 7 at an operating temperature which does not exceed 70° C.

In this embodiment of the invention the pillar 16 is of diameter which is less than the diameter of the outer shell 12 of the coupling element 10. Accordingly, light emitted from the globe 8 of the light bulb 3, as well as being emitted through 360° around the longitudinally extending central axis 13 of the light bulb 3, is also emitted through an angle of approximately 340° around a secondary axis 45 which extends transversely of and through the central axis 13 of the light bulb 3 and through the centre of the partly spherical part 6 of the globe 8. Thus, light is emitted from the globe 8 in all directions with the exception of a cone angle θ of approximately 20° containing the first coupling element 10.

In use, with the light bulb 3 engaged in the light bulb holder 5 and the control circuit 40 electrically coupled to an AC mains electrical power supply by the wires 47, the combination 1 of the light bulb 3 and the light bulb holder 5 is ready for use. Power is delivered to the light emitting devices 7 through the electronic control circuit 40 and the driver 41 in the first sub-housing 42, and the light emitting devices 7 commence to emit light, thus producing light which is directed and emitted through the translucent globe 8. Heat generated by the light emitting devices 7 is conducted from the light emitting devices 7 through the mounting member 18, the pillar 16 and the outer shell 12 of the coupling element 10 of the light bulb 3 into the housing 31 of the light bulb holder 5 where it is sunk and dissipated via the heat exchange fins 34 by natural convection by ambient air circulating through the heat exchange fins 34. In the event that natural convection is insufficient for dissipating the heat generated by the light emitting devices 7 through the heat exchange fins 34, the fan 44 is operated under the control of the control circuit 40 to produce forced convection of the ambient air through the heat exchange fins 34.

Referring now to FIGS. 11 to 16, there is illustrated a light bulb according to the invention, indicated generally by the reference numeral 50, and a light bulb holder also according to the invention, indicated generally by the reference numeral 51. The light bulb 50 is substantially similar to the light bulb 3 described with reference to FIGS. 1 to 10, and similar components are identified by the same reference numerals. The light bulb holder 51 is also substantially similar to the light bulb holder 5 described with reference to FIGS. 1 to 10, and similar components are identified by the same reference numerals. The light bulb 50 and the light bulb holder 51 can be used in combination to produce a combination according to the invention of the light bulb 50 and light bulb holder 51, and furthermore, either of the light bulb 3 or the light bulb 50 may be used in combination with either of the light bulb holders 5 or 51 in order to produce a combination according to the invention, and vice versa.

Turning initially to the light bulb 50, the main difference between the light bulb 50 and the light bulb 3 is in the mounting means for mounting the light emitting devices 7 in the hollow interior region 9 of the globe 8. In this embodiment of the invention the mounting means comprises a mounting platform 52 of brass, copper or aluminium, which is mounted on the distal end 21 of the pillar 16 and is in heat and electrical conducting engagement with the pillar 16. A plurality of the light emitting devices 7 are mounted spaced apart from each other on a top planar surface 54 of the mounting platform 52, and a plurality of light emitting devices 7 are also located at spaced apart intervals on a slightly convex under surface 55 of the mounting platform 52 between an outer peripheral edge 56 of the mounting platform 52 and the pillar 16. One of the input terminals of the light emitting devices 7, namely, the negative input terminals are electrically coupled to the mounting platform 52, and the other one of the input terminals, namely, the positive input terminals of the light emitting devices 7 are electrically coupled by wires (not shown) to the electrical conductor 26 which extends through the bore 25 in the pillar 16 from the contact element 22 in the first coupling element 10.

Otherwise, the light bulb 50 is similar to the light bulb 3, and its use is likewise similar. As mentioned above, the light bulb 50 may be engaged in the light bulb holder 5 or the light bulb holder 51 which will now be described.

Turning now to the light bulb holder 51, the only difference between the light bulb holder 51 and the light bulb holder 5 is in the construction of the heat sink, which in this embodiment of the invention is provided by a plurality of radially extending heat exchange fins 58 which extend radially outwardly from the body member 46 of the light bulb holder 51 and which extend longitudinally relative to the body member 46 and are equi-spaced apart circumferentially around the body member 46. The heat exchange fins 58 terminate in a longitudinally extending sleeve 59 which extends around and is spaced apart from the body member 46, and is coaxial therewith. In this embodiment of the invention an air stream is delivered by the fan (not shown) in the second sub-housing 43 through a plurality of ducts 60 which are defined between the heat exchange fins 58, the body member 46 and the sleeve 59. In this embodiment of the invention the housing 31, the body member 46, the heat exchange fins 58 and the sleeve 59 are of heat and electrically conductive metal, for example, brass, copper, aluminium or the like. An electrically insulating sleeve 61 extends around and covers the sleeve 59 of the housing 31 of the light bulb holder 51.

Otherwise, the light bulb holder 51 is similar to the light bulb holder 5 and its use is likewise similar, and as mentioned above, the light bulb holder 51 may be used in conjunction with either of the light bulb 3 or the light bulb 50.

Referring now to FIGS. 17 to 21, there is illustrated a combination also according to the invention, indicated generally by the reference numeral 70 which comprises a light bulb 71 also according to the invention and a light bulb holder 72 also according to the invention. The light bulb 71 comprises a first coupling element 73 of heat and electrically conductive material, which is substantially similar to the first coupling element 10 of the light bulb 3, and a globe 74 of translucent material which is also substantially similar to the globe 8 of the light bulb 3. In this embodiment of the invention the heat transfer means comprises a heat transfer member 75 of heat conductive and electrically conductive material located in the first coupling element 73 and in tight heat conducting engagement with the first coupling element 73.

A mounting means comprising a mounting platform 76 of heat and electrical conducting material is mounted on the heat transfer member 75. However, in this embodiment of the invention the heat transfer member 75 only projects slightly from the first coupling element 73 into the globe 74, and thus, the mounting platform 76 is located substantially adjacent the first coupling element 73 within the globe 74. A plurality of spaced apart light emitting devices 77, which in this case are also light emitting diodes, are located on the mounting platform 76. The light emitting devices 77 are in heat conducting engagement with the mounting platform 76, which in turn is in heat conducting engagement with the heat transfer member 75 for conducting heat from the light emitting devices 77 to the first coupling element 73 of the light bulb 71, and in turn for conducting heat to the light bulb holder 72 for dissipation thereof.

A bore 78 extends through the heat transfer member 75 for accommodating an electrical conductor 79 from an electrical contact element 80 which is concentric with the first coupling element 73 and electrically insulated from the first coupling element 73 and from the heat transfer member 75 by an electrically insulating material 81. The conductor 79 is also electrically insulated from the heat transfer member 75, and extends to a location just short of the mounting platform 76 for providing electrical power to one of the terminals of the light emitting devices 77 by wires (not shown), but similar to the wires 29 of the light bulb 3. The other one of the terminals of the light emitting devices 77 is electrically coupled to the mounting platform 76. The first coupling element 73, the heat transfer member 75 and the mounting platform 76 are of electrically conductive material and are electrically coupled for providing an electrical ground for the light emitting devices 77.

An external screw thread 82 is provided on the first coupling element 73 of the light bulb 71 for engaging a corresponding internal screw thread 83 in the bulb holder 72 as will be described below. The external screw thread 82 and the internal screw thread 83 may be a fine screw thread, a coarse screw thread, or an Edison screw thread.

The globe 74 comprises a partly spherical part 85 which terminates in a cylindrical part 86 which in turn extends to the first coupling element 73. The light bulb 71 defines a longitudinally extending central axis 88 with which the first coupling element 73, the globe 74, the heat transfer member 75 and the mounting platform 76 are concentric.

A lens 90 mounted on the mounting platform 76 and extending above the light emitting devices 77 terminates in a distal end 91 adjacent the centre of the partly spherical part 85 of the globe 74 for conducting light from the light emitting devices 77 to the centre of the partly spherical part 85 of the globe 74, so that light is emitted from the globe 74 of the light bulb 71 through 360° about the central axis 88 of the light bulb 71, and through approximately 340° around a transversely extending axis extending transversely through the central axis 88 and through the centre of the partly spherical part 85 of the globe 74. In this embodiment of the invention the lens 90 comprises an elongated solid cylindrical member of translucent material, which is shaped at its distal end to be substantially hemispherical for conducting the light from the light emitting devices 77 to the substantially hemispherical distal end 91 thereof from which light is emitted. Light from the light emitting devices 77 is also emitted from the cylindrical surface of the lens 90. The lens 90 may be of a plastics material or glass, either of which would be suitable for conducting light from the light emitting devices 77. The lens 90 may also be provided as an elongated translucent tubular member which may or may not terminate in a substantially hemispherical distal end.

Turning now to the light bulb holder 72, the light bulb holder 72 comprises a body member 93 of circular transverse cross-section and of heat conductive material, which is also electrically conductive. The body member 93 defines a longitudinally extending central axis 94 which coincides with the central axis 88 of the light bulb 71, when the light bulb 71 is coupled to the light bulb holder 72. A second coupling element comprising a socket 95 which is formed concentrically in one end of the body member 93, and which is internally threaded with the screw thread 83 complimentary to the external screw thread 82 on the first coupling element 73 of the light bulb 71, releasably and electrically engages the first coupling element 73 of the light bulb 71 with heat conducting engagement between the first coupling element 73 and the body member 93.

The body member 93 forms a heat sink for sinking heat generated by the light emitting devices 77, which comprises a plurality of heat exchange fins 97 which are equi-spaced apart circumferentially around the body member 93 and extend longitudinally along the body member 93. The heat exchange fins 97 when viewed in plan along the central axis 94 of the light bulb holder 72 are of slightly arcuate shape, and extend substantially radially outwardly from the body member 93.

An electrically conductive contact element 98 is located centrally in the socket 95 in the body member 93 for electrically engaging the contact element 80 of the light bulb 71. The contact element 98 is electrically insulated from the body member 93 by an electrically insulating material 99 located in a base 100 of the socket 95. A central bore 101 extending concentrically through the body member 93 from the socket 95 accommodates an electrical conductor 103 extending from the contact element 98 to provide an electrical power supply to the contact element 98.

In this embodiment of the invention the control circuit (not shown) and the driver (also not shown) for powering the light emitting devices 77 in the light bulb 71 are located in a sub-housing 105 upstream and remote from the light bulb holder 72 for applying an appropriate low voltage power supply to the light emitting devices 77. The positive electrical supply from the control and driver circuits (not shown) in the sub-housing 105 is applied to the conductor 103, while the negative or ground supply is applied to the body member 93 of the light bulb holder 72 so that the positive supply is applied to the positive input terminals of the light emitting devices 77 through the conductor 103, the contact elements 98 and 80, the conductor 79 and the wires (not shown) which extend through the mounting platform 76. The negative or ground supply is applied to the negative input terminals of the light emitting devices 77 through the body member 93 of the light bulb holder 72, the first coupling element 73, the heat transfer member 75 and the mounting platform 76 of the light bulb 71.

In this embodiment of the invention the light bulb holder 72 is not provided with a fan. However, the body member 93 is dimensioned to be of sufficient thermal mass, and the heat exchange fins 97 are also dimensioned to provide sufficient heat dissipation by natural convection with ambient air in order to maintain the temperature of the light emitting devices 77 below the critical temperature of 70° C.

In use, with the control and driver circuits located in the sub-housing 105 coupled to a suitable AC mains electrical power supply, and with the light bulb 71 coupled to the light bulb holder 72 with the first coupling element 73 engaged in the socket 95 of the body member 93 of the light bulb holder 72, the light bulb 71 and the light bulb holder 72 are ready for use. On power being applied to the control and driver circuits located in the sub-housing 105, the light emitting devices 77 commence emitting light. Heat generated by the light emitting devices 77 is conducted through the mounting platform 76, the heat transfer member 75, the first coupling element 73 of the light bulb 71 into the body member 93 of the light bulb holder 72 from where it is dissipated by natural convection of air through the heat exchange fins 97.

Referring now to FIGS. 22 to 24, there is illustrated a combination 110 also according to the invention of a light bulb 111 also according to the invention and the light bulb holder 112 also according to the invention. The combination 110 of the light bulb 111 and the light bulb holder 112 is substantially similar to the combination 70 of the light bulb 71 and the light bulb holder 72, and similar components of the combination 110 and of the light bulb 111 and the light bulb holder 112 are identified by the same reference numerals. The only difference between the light bulb 111 and the light bulb 71, and the light bulb holder 112 and the light bulb holder 72 is in the contact elements for providing an electrical supply from the light bulb holder 112 to the light bulb 111. Additionally, in this embodiment of the invention the lens 90 is omitted from the light bulb 111. However, the globe 74 of the light bulb 111 is of a diffusion type translucent material.

In this embodiment of the invention a pair of contact elements, namely, a first contact element 115 and a second contact element 116, both of electrically conductive metal, are provided at the end 117 of the first coupling element 73 of the light bulb 111. The first contact element 115 is centrally located on the first coupling element 73 adjacent the end 117 and is concentric with the first coupling element 73 and with the central axis 88 of the light bulb 111, and is electrically coupled to the conductor 79 of the light bulb 111. The second contact element 116 comprises a ring contact element which extends around the first contact element 115 and is concentric with the first contact element 115 and in turn with the central axis 88 of the light bulb 111. The first and second contact elements 115 and 116 are electrically insulated from each other, and are both electrically insulated from the first coupling element 73 by an electrically insulating material 119 in the first coupling element 73. The electrically insulating material 119 also electrically insulates the first and second contact elements 115 and 116 from the heat transfer member 75. A second electrical conductor 120 which is electrically coupled to the second contact element 116 extends through the bore 78 in the heat transfer member 75, and is electrically coupled to the mounting platform 76, so that the light emitting devices 77 are electrically powered through the first and second contact elements 115 and 116 and the conductor 79 and the second conductor 120.

Corresponding first and second electrically conductive contact elements 121 and 122, respectively, are located in the base 100 of the socket 95 in the light bulb holder 112. The first contact element 121 is located concentrically with the socket 95 and the central axis 94 of the light bulb holder 112. The second contact element 122 comprises a ring contact element which extends around and is concentric with the first contact element 121 and in turn with the central axis 94 of the light bulb holder 112. The first and second contact elements 121 and 122 are electrically insulated from each other, and both are electrically insulated from the body member 93 by an electrically insulating material 123 in the base 100 of the socket 95.

The electrical conductor 103 extends from the first contact element 121 through the bore 101 in the body member 93 of the light bulb holder 112 for applying an electrical supply to the first contact element 121. A second electrical conductor 125 is electrically coupled to the second contact element 122 and extends from the second contact element 122 through the bore 101 in the body member 93 of the light bulb holder 112 for applying an electrical supply to the second contact element 122. In this embodiment of the invention the positive electrical supply is applied to the conductor 103 from the control and driver circuits (not shown) which are located in the sub-housing 105 upstream and remote from the light bulb holder 112, and the negative of the power supply is applied to the second conductor 125 from the control and driver circuits (not shown) in the sub-housing 105. Accordingly, in this embodiment of the invention electrical continuity is not required between the body member 93 of the light bulb holder 112 and the first coupling element 73 of the light bulb 111, since the positive and negative of the electrical power supply to the light emitting devices 77 is applied through the conductors 103 and 125 and the first and second contact elements 121 and 122 of the light bulb holder 112 and through the first and second contact elements 115 and 116 and the conductors 79 and 120 of the light bulb 111 to the light emitting devices 77.

The absence of the lens in the light bulb 111 does not to any significant extent restrict the directions from which light is emitted from the globe 74 of the light bulb 111 once the globe 74 of the light bulb 111 is of a diffusion type translucent material, rather than a transparent material.

Otherwise, the combination 110 of the light bulb 111 and the light bulb holder 112 is similar to the combination 70 of the light bulb 71 and the light bulb holder 72. However, in this embodiment of the invention, since the electrical power supply is applied to the light emitting diodes 77 through the conductors 103 and 79 and the conductors 125 and 120, neither the body member 93 of the light bulb holder 112 nor the first coupling element 73, the heat transfer member 75 and the mounting platform 76 of the light bulb holder 111 need be of an electrically conductive material, and may be of any suitable heat conductive material, for example, a thermal plastics material.

The advantages of the combination of the light bulbs according to the invention and the light bulb holders also according to the invention are many. A particularly important advantage of the invention is that by virtue of the fact that the light bulb holders form a heat sink for sinking and dissipating heat generated by the light emitting devices, the light bulbs can be provided without heat exchange fins or any other heat exchange means, since the heat sinking and dissipation of heat is carried out from the light bulb holders, rather than by heat exchange means in the light bulbs, as has been the case in such light emitting device light bulbs known heretofore. This significantly reduces the amount of heat conductive metal required in the light bulbs according to the invention as opposed to the amount of heat conductive metal required in such light emitting device light bulbs known heretofore. The reduction in the amount of metal required in the light bulbs according to the invention produces two particularly important advantages. Firstly, the cost of producing such light emitting device light bulbs according to the invention is significantly reduced over the cost of producing such light bulbs known heretofore, and secondly, disposing of the light bulbs according to the invention is significantly less complex than disposing of light emitting device light bulbs known heretofore.

A further and particularly important advantage of the light bulbs according to the invention is that the light emitted by the light emitting devices is emitted from the light bulbs through the globe thereof through 360° around the longitudinally extending central axis of the light bulbs, and is emitted through an angle of approximately 340° or more around any axis extending perpendicularly to and through the central longitudinal axis of the light bulbs extending through the centre of the partly spherical part of the globe, so that light is emitted from the globe in all directions with the exception of the cone angle θ which contains the first coupling element. Thus, the light bulbs are suitable for uses for which a conventional incandescent light bulb may be used, for example, in a hanging pendant lamp, a wall light, a table lamp, a standard lamp or any other fixture where it is desired that light should emanate from the globe of the light bulb through substantially 360° about the central axis of the light bulb, and in all directions within an angle of approximately 340° about an axis extending perpendicularly to and through the central axis of the light bulb and through the centre of the partly spherical part of the globe.

A further advantage of the invention is that by virtue of the fact that heat is dissipated from the light bulbs through the light bulb holders, the light bulbs according to the invention can be provided with light emitting devices which produce a much higher light power output, which is limited only, and largely by the heat dissipating capacity of the heat sink and the heat conductive properties of the external and internal screw threads of the first and second coupling elements.

An additional advantage of the combinations of the light bulbs and the light bulb holders according to the invention is that by virtue of the fact that the control circuit and the driver for the light emitting devices is located in the light bulb holder, or remote and upstream therefrom, the light bulb holder becomes a low voltage light bulb holder operating at a voltage of 12 volts or less. This provides a particularly important safety advantage, in that there is no danger of high voltages in the housing of the light bulb holder. This advantage is particularly important in the case of table lamps, where a light bulb can be removed from a light bulb holder by a child, who can then insert his or her fingers into the light bulb holder with fatal consequences in the case of an AC mains voltage conventional incandescent light bulb table lamp.

While the pillar 16 and the outer shell 12 of the first coupling element 10 as well as the partly spherical mounting member and the mounting platform of the light bulbs 3 and 50, respectively, have been described as being of brass, copper or aluminium, the materials of these elements may be of any other suitable heat and electrically conductive material.

It is also envisaged that in certain cases the materials of the pillar, the outer shell of the coupling element, the spherical mounting member and the mounting platform of the light bulbs 3 and 50 need not necessarily be of an electrically conductive material, and where the materials of these elements are not electrically conductive, other suitable electrically conductive elements would be provided for supplying electrical power to the light emitting devices. For example, it is envisaged that a pair of electrical contact elements may be provided in the first coupling element of the light bulb which would be engageable with a pair of corresponding coupling elements which would be located in the socket of the light bulb holder, as, for example, in the embodiment described with reference to FIGS. 17 to 24. Similarly, it is envisaged that the body member of the light bulb holder need not be of an electrically conductive material in cases where a pair of contact elements are provided in the socket of the light bulb holder engageable with a corresponding pair of contact elements in the first coupling element of the light bulb. In such cases, it is envisaged that a pair of electrical conductors would extend through the bore in the pillar of the light bulb from the contact elements for supplying electrical power to the light emitting devices, and a pair of electrical conductors would extend through the bore in the body member for applying an electrical power supply to the contact elements in the socket of the light bulb holder. Needless to say, other suitable arrangements for supplying power to the contact elements in the light bulb holder and for supplying power from the contact elements in the first coupling element of the light bulb to the light emitting devices may be provided.

It is also envisaged that while the light bulbs have been described as comprising a plurality of light emitting devices, in certain embodiments of the invention, a single light emitting device may be provided.

It will also be appreciated that while the light emitting devices have been described as surface mounted light emitting diodes, the light emitting devices may comprise any other surface mounted light emitting device besides surface mounted light emitting diodes and it will also be appreciated that it is not essential that the light emitting devices be surface mounted devices.

While the first and second coupling elements of the light bulbs and the light bulb holders have been described as being provided with specific types of external and internal screw threads, the first and second coupling elements of the light bulbs and the light bulb holders may be provided with any other suitable screw threads. Needless to say, in certain cases the plug element of the first coupling element may be provided with a bayonet coupling fitting, and the light bulb holder would be provided with a complimentary bayonet coupling fitting. Needless to say, the first and second coupling elements of the light bulbs and the light bulb holders may be provided in the form of any other suitable interengageable complimentary formations.

While the light bulb holders described with reference to FIGS. 1 to 16 have been described as comprising a fan, while this is advantageous, it is not essential.

It is also envisaged that instead of providing the control circuitry and the driver for the light emitting devices in the light bulb holder, or in a sub-housing coupled to the light bulb holder, the control circuitry and driver may be located remote of the light bulb holder and upstream therefrom, as in the case of the light bulb holders described with reference to FIGS. 17 to 24.

While the globes of the light bulbs which are described with reference to FIGS. 1 to 24 and the lens of the light bulb which has been described with reference to FIGS. 17 to 21 have been described as being of a translucent material, both the globes and the lens may be of a translucent or a transparent material.

While in the embodiment of the light bulb and the light bulb holder which has been described with reference to FIGS. 22 to 24 two electrical contact elements have been described as being provided in the first coupling element of the light bulb and the second coupling element of the light bulb holder, and while the respective pairs of contact elements have been described as being located concentrically with each other, in certain cases, it is envisaged that it may not be essential to provide each pair of contact elements concentric with each other, for example, in certain cases, the contact elements may be located side by side but spaced apart from each other. This would be particularly so in cases where the first and second coupling elements of the light bulb and the light bulb holder were configured as bayonet connections.

Furthermore, it is envisaged that even in the cases where the first and second coupling elements are provided with screw threads, it is not necessary that the second contact element in both the first and second coupling elements be provided as a ring contact element, it would be sufficient if one of the second contact elements in either the first or second coupling element were provided as a ring contact, and the other of the second contact elements could be provided as a single disc contact element. However, the disc contact element would have to be spaced apart from the corresponding central axis a distance similar to the radius of the ring contact element.

The invention claimed is:

1. A light bulb holder comprising:

a coupling element defining a longitudinally extending central axis and being releasably engageable with a complementary coupling element of a light bulb for coupling the light bulb to the light bulb holder, the coupling element of the light bulb holder being configured to engage the coupling element of the light bulb for transferring heat from the light bulb to the light bulb holder through the coupling element of the light bulb holder, a heat sink in heat conducting engagement with the coupling element of the light bulb holder for sinking and dissipating heat transferred from the light bulb, and at least one electrically conductive contact element adjacent the coupling element of the light bulb holder, the at least one contact element being configured to electrically contact a corresponding electrically conductive contact element of the light bulb, wherein the heat sink comprises a heat exchanger comprising:

an elongated body member, and a plurality of heat exchange fins extending outwardly from the body member, the coupling element is formed in the body member, and the heat exchange fins extend in a generally longitudinal direction along the body member substantially parallel to the central axis and radially therefrom spaced apart circumferentially around the body member.

2. A bulb holder as claimed in claim 1 in which the heat exchange fins are equi-spaced apart circumferentially around the body member.

3. A bulb holder as claimed in claim 1 in which the coupling element of the light bulb holder comprises a socket element configured to engage the coupling element of a light bulb.

4. A bulb holder as claimed in claim 1 in which the at least one contact element is located concentrically with the central axis in the coupling element of the bulb holder.

5. A bulb holder as claimed in claim 1 in which a bore extends through the body member for accommodating an electrical conductor extending from each contact element located in the coupling element.

6. A combination of a light bulb and a light bulb holder, the light bulb comprising:

a first coupling element for releasably coupling the light bulb to the light bulb holder and being configured for transferring heat from the light bulb to the light bulb holder, and at least one electrically conductive contact element located adjacent the first coupling element, the light bulb holder comprising:

a second coupling element defining a longitudinally extending central axis, the second coupling element being in releasable heat transfer engagement with the first coupling element of the light bulb for coupling the light bulb to the light bulb holder and for transferring heat from the light bulb to the light bulb holder, a heat sink in heat conducting engagement with the second coupling element for sinking and dissipating heat transferred from the light bulb, and at least one electrically conductive contact element adjacent the second coupling element in electrically conductive contact with the contact element of the light bulb for providing an electrical power supply to the light bulb, wherein the heat sink comprises a heat exchanger comprising:

an elongated body member, and a plurality of heat exchange fins extending outwardly from the body member, the second coupling element is formed in the body member, and the heat exchange fins extend in a generally longitudinal direction along the body member substantially parallel to the central axis and radially therefrom spaced apart circumferentially around the body member.

7. A combination as claimed in claim 6 in which the first coupling element defines a longitudinally extending central axis of the light bulb coinciding with the longitudinally extending central axis of the light bulb holder.

8. A combination as claimed in claim 6 in which the first coupling element of the light bulb comprises a plug element, and the second coupling element of the light bulb holder defines a socket for receiving the corresponding first coupling element of the light bulb.

9. A combination of a light bulb and a bulb holder as claimed in claim 6 in which the light bulb comprises a globe of translucent material defining a hollow interior region, a mounting means located in the hollow interior region of the globe, and at least one energy efficient light emitting device located in the hollow interior region of the globe on the mounting means and electrically coupled to the at least one contact element, and a heat transfer means coupled to the mounting means and to the first coupling element for transferring heat from the at least one light emitting device to the first coupling element.

10. A combination as claimed in claim 9 in which the heat transfer means of the light bulb extends between the mounting means and the first coupling element, and is in heat conducting engagement with the first coupling element and the mounting means.

11. A combination as claimed in claim 9 in which the mounting means is located in the globe towards the first coupling element.

12. A combination as claimed in claim 6 which the at least one contact element of the light bulb is concentrically located with the first coupling element, and the at least one contact element of the light bulb holder is concentrically located with the second coupling element.

13. A combination as claimed in claim 6 in which a fan is located in the bulb holder to provide forced convection for dissipating heat from the heat sink.

14. A bulb holder as claimed in claim 1 in which the heat exchange fins are of arcuate shape when viewed in plan along the central axis defined by the bulb holder.

15. A bulb holder as claimed in claim 1 in which the coupling element is concentric with the body member.

16. A bulb holder as claimed in claim 1 in which a pair of electrically conductive contact elements are located adjacent the coupling element, a first one of the pair of the contact elements being located concentrically with the coupling element, and a second one of the pair of contact elements extending around the first contact element.

17. A bulb holder as claimed in claim 1 in which a driver for driving at least one light emitting device of a light bulb coupled to the bulb holder is located in the bulb holder.

18. A bulb holder as claimed in claim 1 in which a fan is located in the bulb holder to provide forced convection for dissipating heat from the heat sink.

* * * * *